US008191894B2

(12) United States Patent
Grauzer et al.

(10) Patent No.: US 8,191,894 B2
(45) **Date of Patent: *Jun. 5, 2012**

(54) CARD FEED MECHANISMS FOR CARD-HANDLING APPARATUSES AND RELATED METHODS

(75) Inventors: Attila Grauzer, Las Vegas, NV (US); Feraidoon Bourbour, Minneapolis, MN (US); Troy D. Nelson, Big Lake, MN (US); Robert J. Rynda, Las Vegas, NV (US); Paul K. Scheper, Eden Prairie, MN (US); James Bernard Stasson, Chanhassen, MN (US); Ronald R. Swanson, Watertown, MN (US)

(73) Assignee: Shuffle Master, Inc., Las Vegas, NV (US)

( * ) Notice: Subject to any disclaimer, the term of this patent is extended or adjusted under 35 U.S.C. 154(b) by 335 days.

This patent is subject to a terminal disclaimer.

(21) Appl. No.: 12/387,037

(22) Filed: Apr. 27, 2009

(65) Prior Publication Data

US 2011/0006480 A1 Jan. 13, 2011

Related U.S. Application Data

(63) Continuation of application No. 11/365,935, filed on Mar. 1, 2006, now Pat. No. 7,523,936, which is a continuation of application No. 10/725,833, filed on Dec. 2, 2003, now Pat. No. 7,413,191, which is a continuation of application No. 09/912,879, filed on Jul. 25, 2001, now Pat. No. 6,655,684, which is a continuation-in-part of application No. 09/688,597, filed on Oct. 16, 2000, now Pat. No. 6,588,750, which is a continuation-in-part of application No. 09/060,627, filed on Apr. 15, 1998, now Pat. No. 6,149,154.

(51) Int. Cl.
*A63F 1/12* (2006.01)

(52) U.S. Cl. ..... 273/149 R
(58) Field of Classification Search ..... 273/149 R, 273/149 P
See application file for complete search history.

(56) References Cited

U.S. PATENT DOCUMENTS 793,489 A 6/1905 Williams (Continued)

FOREIGN PATENT DOCUMENTS

AU 50254/79 3/1980

(Continued)

OTHER PUBLICATIONS

Press Release for Alliance Gaming Corp., Jul. 26, 2004—Alliance Gaming Announces Contract With Galaxy Macau for New MindPlay Baccarat Table Technology, http://biz.yahoo.com/prnews.

(Continued)

*Primary Examiner* — Benjamin Layno
(74) *Attorney, Agent, or Firm* — TraskBritt

(57) ABSTRACT

Apparatuses and methods for moving playing cards from a first group of cards into plural hands of cards, wherein each of the hands contains a random arrangement of cards. The apparatus may comprise a card receiver for receiving the first group of cards, a single stack of card-receiving compartments generally adjacent to the card receiver, the stack generally vertically movable, an elevator for moving the stack, a card-moving mechanism between the card receiver and the stack, and a microprocessor that controls the card-moving mechanism and the elevator so that an individual card is moved into an identified compartment. The number of compartments receiving cards and the number of cards moved to each compartment may be selected. Apparatuses for feeding cards may comprise a surface for supporting a stack of cards, a feed roller with a frictional outer surface, a drive mechanism for causing rotation of the feed roller, a pair of speed-up rollers to advance the cards out of the feed roller, and a clutch mechanism for disengaging the feed roller from the drive mechanism as the card comes into contact with the speed-up rollers.

9 Claims, 18 Drawing Sheets

U.S. PATENT DOCUMENTS

| | | | | |
|---|---|---|---|---|
| 1,014,219 | A | | 1/1912 | Hall |
| 2,001,220 | A | | 5/1935 | Smith |
| 2,001,918 | A | | 5/1935 | Nevius |
| 2,016,030 | A | | 10/1935 | Woodruff et al. |
| 2,043,343 | A | | 6/1936 | Warner |
| 2,065,824 | A | | 12/1936 | Plass |
| 2,778,644 | A | | 1/1957 | Stephenson |
| 2,937,739 | A | | 5/1960 | Levy |
| 2,950,005 | A | | 8/1960 | MacDonald |
| 3,147,978 | A | | 9/1964 | Sjöstrand |
| 3,222,071 | A | | 12/1965 | Lang |
| 3,235,741 | A | | 2/1966 | Plaisance |
| 3,312,473 | A | | 4/1967 | Friedman et al. |
| 3,597,076 | A | * | 8/1971 | Hubbard et al. ..... 355/29 |
| 3,680,853 | A | * | 8/1972 | Houghton et al. ..... 271/3.2 |
| 3,690,670 | A | | 9/1972 | Cassady et al. |
| 3,716,238 | A | | 2/1973 | Porter |
| 3,761,079 | A | * | 9/1973 | Azure, Jr. ..... 271/116 |
| 3,897,954 | A | | 8/1975 | Erickson et al. |
| 3,929,339 | A | | 12/1975 | Mattioli |
| 3,944,230 | A | | 3/1976 | Fineman |
| 4,159,581 | A | | 7/1979 | Lichtenberg |
| 4,232,861 | A | | 11/1980 | Maul |
| 4,361,393 | A | | 11/1982 | Noto |
| 4,368,972 | A | | 1/1983 | Naramore |
| 4,385,827 | A | | 5/1983 | Naramore |
| 4,397,469 | A | | 8/1983 | Carter, III |
| 4,494,197 | A | | 1/1985 | Troy et al. |
| 4,497,488 | A | | 2/1985 | Plevyak et al. |
| 4,513,969 | A | | 4/1985 | Samsel, Jr. |
| 4,515,367 | A | | 5/1985 | Howard |
| 4,534,562 | A | | 8/1985 | Cuff et al. |
| 4,566,782 | A | | 1/1986 | Britt et al. |
| 4,586,712 | A | | 5/1986 | Lorber et al. |
| 4,659,082 | A | | 4/1987 | Greenberg |
| 4,667,959 | A | | 5/1987 | Pfeiffer et al. |
| 4,741,524 | A | | 5/1988 | Bromage |
| 4,750,743 | A | | 6/1988 | Nicoletti |
| 4,755,941 | A | | 7/1988 | Bacchi |
| 4,770,421 | A | | 9/1988 | Hoffman |
| 4,807,884 | A | | 2/1989 | Breeding |
| 4,822,050 | A | | 4/1989 | Normand et al. |
| 4,832,342 | A | | 5/1989 | Plevyak et al. |
| 4,900,009 | A | | 2/1990 | Kitahara et al. |
| 4,926,327 | A | | 5/1990 | Sidley |
| 4,951,950 | A | | 8/1990 | Normand et al. |
| 4,969,648 | A | | 11/1990 | Hollinger et al. |
| 4,993,587 | A | * | 2/1991 | Abe ..... 221/21 |
| 4,995,615 | A | | 2/1991 | Cheng |
| 5,000,453 | A | | 3/1991 | Stevens et al. |
| 5,067,713 | A | | 11/1991 | Soules et al. |
| 5,121,921 | A | | 6/1992 | Friedman et al. |
| 5,179,517 | A | | 1/1993 | Sarbin et al. |
| 5,199,710 | A | | 4/1993 | Lamle |
| 5,209,476 | A | | 5/1993 | Eiba |
| 5,224,712 | A | | 7/1993 | Laughlin et al. |
| 5,240,140 | A | | 8/1993 | Huen |
| 5,257,179 | A | | 10/1993 | DeMar |
| 5,261,667 | A | | 11/1993 | Breeding |
| 5,275,411 | A | | 1/1994 | Breeding |
| 5,276,312 | A | | 1/1994 | McCarthy |
| 5,283,422 | A | | 2/1994 | Storch et al. |
| 5,288,081 | A | | 2/1994 | Breeding |
| 5,303,921 | A | | 4/1994 | Breeding |
| 5,356,145 | A | | 10/1994 | Verschoor |
| 5,362,053 | A | | 11/1994 | Miller |
| 5,374,061 | A | | 12/1994 | Albrecht |
| 5,382,024 | A | | 1/1995 | Blaha |
| 5,382,025 | A | | 1/1995 | Sklansky et al. |
| 5,390,910 | A | | 2/1995 | Mandel et al. |
| 5,431,399 | A | | 7/1995 | Kelley |
| 5,437,462 | A | | 8/1995 | Breeding |
| 5,470,079 | A | | 11/1995 | LeStrange et al. |
| 5,584,483 | A | | 12/1996 | Sines et al. |
| 5,586,766 | A | | 12/1996 | Forte et al. |
| 5,586,936 | A | | 12/1996 | Bennett et al. |
| 5,605,334 | A | | 2/1997 | McCrea, Jr. |
| 5,613,912 | A | | 3/1997 | Slater |
| 5,655,961 | A | | 8/1997 | Acres et al. |
| 5,669,816 | A | | 9/1997 | Garczynski et al. |
| 5,676,372 | A | | 10/1997 | Sines et al. |
| 5,681,039 | A | | 10/1997 | Miller |
| 5,683,085 | A | | 11/1997 | Johnson et al. |
| 5,690,324 | A | | 11/1997 | Otomo et al. |
| 5,692,748 | A | | 12/1997 | Frisco et al. |
| 5,695,189 | A | | 12/1997 | Breeding et al. |
| 5,707,287 | A | | 1/1998 | McCrea, Jr. |
| 5,718,427 | A | | 2/1998 | Cranford et al. |
| 5,722,893 | A | | 3/1998 | Hill et al. |
| 5,735,525 | A | | 4/1998 | McCrea, Jr. |
| 5,772,505 | A | | 6/1998 | Garczynski et al. |
| 5,779,546 | A | | 7/1998 | Meissner et al. |
| 5,781,647 | A | | 7/1998 | Fishbine et al. |
| 5,788,574 | A | | 8/1998 | Ornstein et al. |
| 5,803,808 | A | | 9/1998 | Strisower |
| 5,911,626 | A | | 6/1999 | McCrea, Jr. |
| 5,919,090 | A | | 7/1999 | Mothwurf |
| 5,941,769 | A | | 8/1999 | Order |
| 5,944,310 | A | | 8/1999 | Johnson et al. |
| D414,527 | S | | 9/1999 | Tedham |
| 5,989,122 | A | | 11/1999 | Roblejo |
| 6,019,368 | A | | 2/2000 | Sines et al. |
| 6,039,650 | A | | 3/2000 | Hill |
| 6,068,258 | A | | 5/2000 | Breeding et al. |
| 6,071,190 | A | | 6/2000 | Weiss et al. |
| 6,093,103 | A | | 7/2000 | McCrea, Jr. |
| 6,117,012 | A | | 9/2000 | McCrea, Jr. |
| 6,126,166 | A | | 10/2000 | Lorson et al. |
| 6,139,014 | A | | 10/2000 | Breeding et al. |
| 6,149,154 | A | | 11/2000 | Grauzer et al. |
| 6,165,069 | A | | 12/2000 | Sines et al. |
| 6,165,072 | A | | 12/2000 | Davis et al. |
| 6,217,447 | B1 | | 4/2001 | Lofink et al. |
| 6,250,632 | B1 | | 6/2001 | Albrecht |
| 6,254,096 | B1 | | 7/2001 | Grauzer et al. |
| 6,254,484 | B1 | | 7/2001 | McCrea, Jr. |
| 6,267,248 | B1 | | 7/2001 | Johnson et al. |
| 6,267,671 | B1 | | 7/2001 | Hogan |
| 6,270,404 | B2 | | 8/2001 | Sines et al. |
| 6,293,864 | B1 | | 9/2001 | Romero |
| 6,299,536 | B1 | | 10/2001 | Hill |
| 6,313,871 | B1 | | 11/2001 | Schubert |
| 6,325,373 | B1 | | 12/2001 | Breeding et al. |
| 6,346,044 | B1 | | 2/2002 | McCrea, Jr. |
| 6,361,044 | B1 | | 3/2002 | Block et al. |
| 6,403,908 | B2 | | 6/2002 | Stardust et al. |
| 6,446,864 | B1 | | 9/2002 | Kim et al. |
| 6,460,848 | B1 | | 10/2002 | Soltys et al. |
| 6,517,435 | B2 | | 2/2003 | Soltys et al. |
| 6,517,436 | B2 | | 2/2003 | Soltys et al. |
| 6,520,857 | B2 | | 2/2003 | Soltys et al. |
| 6,527,271 | B2 | | 3/2003 | Soltys et al. |
| 6,530,836 | B2 | | 3/2003 | Soltys et al. |
| 6,530,837 | B2 | | 3/2003 | Soltys et al. |
| 6,532,297 | B1 | | 3/2003 | Lindquist |
| 6,533,276 | B2 | | 3/2003 | Soltys et al. |
| 6,533,662 | B2 | | 3/2003 | Soltys et al. |
| 6,579,180 | B2 | | 6/2003 | Soltys et al. |
| 6,579,181 | B2 | | 6/2003 | Soltys et al. |
| 6,582,301 | B2 | | 6/2003 | Hill |
| 6,582,302 | B2 | | 6/2003 | Romero |
| 6,585,586 | B1 | | 7/2003 | Romero |
| 6,588,750 | B1 | | 7/2003 | Grauzer et al. |
| 6,588,751 | B1 | | 7/2003 | Grauzer et al. |
| 6,595,857 | B2 | | 7/2003 | Soltys et al. |
| 6,616,535 | B1 | | 9/2003 | Nishizaki et al. |
| 6,622,185 | B1 | | 9/2003 | Johnson et al. |
| 6,629,889 | B2 | | 10/2003 | Mothwurf |
| 6,629,894 | B1 | | 10/2003 | Purton |
| 6,638,161 | B2 | | 10/2003 | Soltys et al. |
| 6,645,068 | B1 | | 11/2003 | Kelly et al. |
| 6,645,077 | B2 | | 11/2003 | Rowe |
| 6,651,981 | B2 | | 11/2003 | Grauzer et al. |
| 6,651,982 | B2 | | 11/2003 | Grauzer et al. |
| 6,652,379 | B2 | | 11/2003 | Soltys et al. |
| 6,655,684 | B2 | * | 12/2003 | Grauzer et al. ..... 273/149 R |
| 6,663,490 | B2 | | 12/2003 | Soltys et al. |

| | | | |
|---|---|---|---|
| 6,666,768 | B1 | 12/2003 | Akers |
| 6,685,567 | B2 | 2/2004 | Cockerille et al. |
| 6,685,568 | B2 | 2/2004 | Soltys et al. |
| 6,688,979 | B2 | 2/2004 | Soltys et al. |
| 6,712,696 | B2 | 3/2004 | Soltys et al. |
| 6,719,634 | B2 | 4/2004 | Mishina et al. |
| 6,726,205 | B1 | 4/2004 | Purton |
| 6,746,333 | B1 | 6/2004 | Onda et al. |
| 6,758,751 | B2 | 7/2004 | Soltys et al. |
| 6,758,757 | B2 | 7/2004 | Luciano, Jr. et al. |
| 6,804,763 | B1 | 10/2004 | Stockdale et al. |
| 7,231,812 | B1 | 6/2007 | Lagare |
| 7,264,241 | B2 | 9/2007 | Schubert et al. |
| 7,322,576 | B2 | 1/2008 | Grauzer et al. |
| 7,374,170 | B2 | 5/2008 | Grauzer et al. |
| 7,407,438 | B2 | 8/2008 | Schubert et al. |
| 2001/0036231 | A1 | 11/2001 | Easwar et al. |
| 2001/0036866 | A1 | 11/2001 | Stockdale et al. |
| 2002/0107067 | A1 | 8/2002 | McGlone et al. |
| 2002/0187830 | A1 | 12/2002 | Stockdale et al. |
| 2003/0087694 | A1 | 5/2003 | Storch |
| 2004/0116179 | A1 | 6/2004 | Nicely et al. |
| 2005/0062227 | A1 | 3/2005 | Grauzer et al. |
| 2005/0242500 | A1 | 11/2005 | Downs, III |
| 2006/0033270 | A1 | 2/2006 | Grauzer et al. |
| 2006/0279040 | A1 | 12/2006 | Downs et al. |
| 2008/0006998 | A1 | 1/2008 | Grauzer et al. |

FOREIGN PATENT DOCUMENTS

| | | |
|---|---|---|
| EP | 0 777 514 | 2/2000 |
| WO | WO 87/00764 | 2/1987 |
| WO | WO 98/14249 | 4/1998 |
| WO | WO 98/40136 | 9/1998 |
| WO | WO 99/52611 | 10/1999 |
| WO | WO 00/51076 | 8/2000 |
| WO | WO 2006/031472 | 3/2006 |

OTHER PUBLICATIONS

Tracking the Tables, by Jack Bularsky, Casino Journal, May 2004, vol. 17, No. 5, pp. 44-47.

Scarne's Encyclopedia of Games by John Scarne, 1973, "Super Contract Bridge", p. 153.

CD Labeled "Shuffler Art". Attached to this 1449 is a spreadsheet having the names of the individual files within the CD.

DVD Labeled "Luciano Decl. Ex. K".

DVD Labeled "Solberg Decl. Ex. C".

DVD labeled Morrill Decl. Ex. A:.

DVD labeled Exhibit 1.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

Service Manual/User Manual for Single Deck Shuffiers: BG1, BG2 and BG3 by Shuffle Master © 1996.

* cited by examiner

Fig. 2
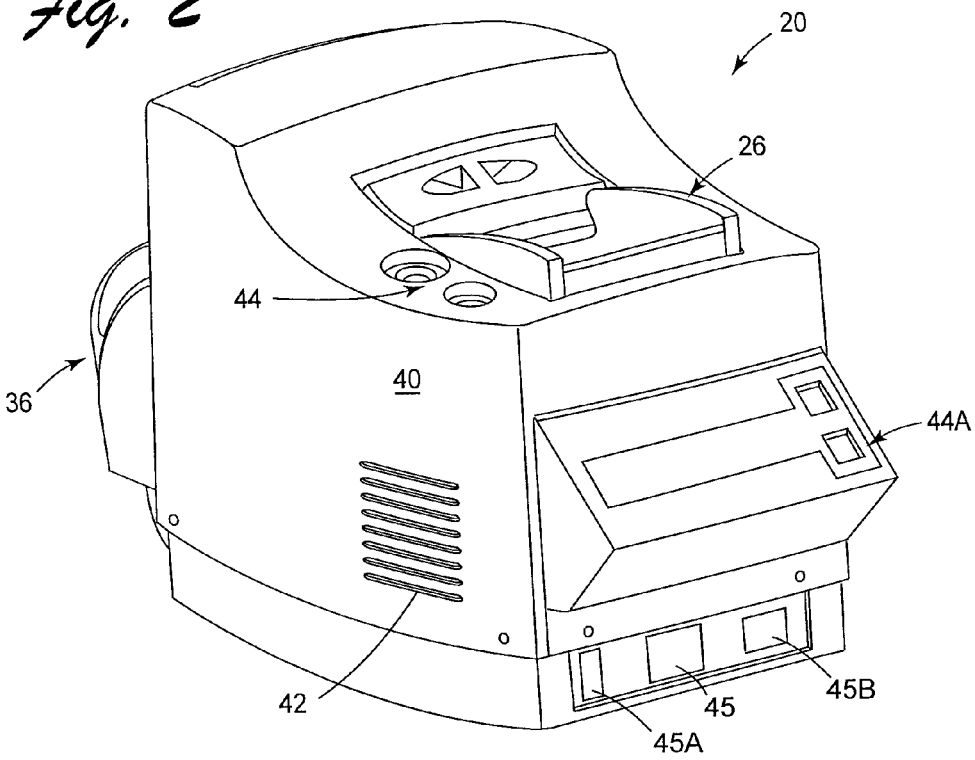
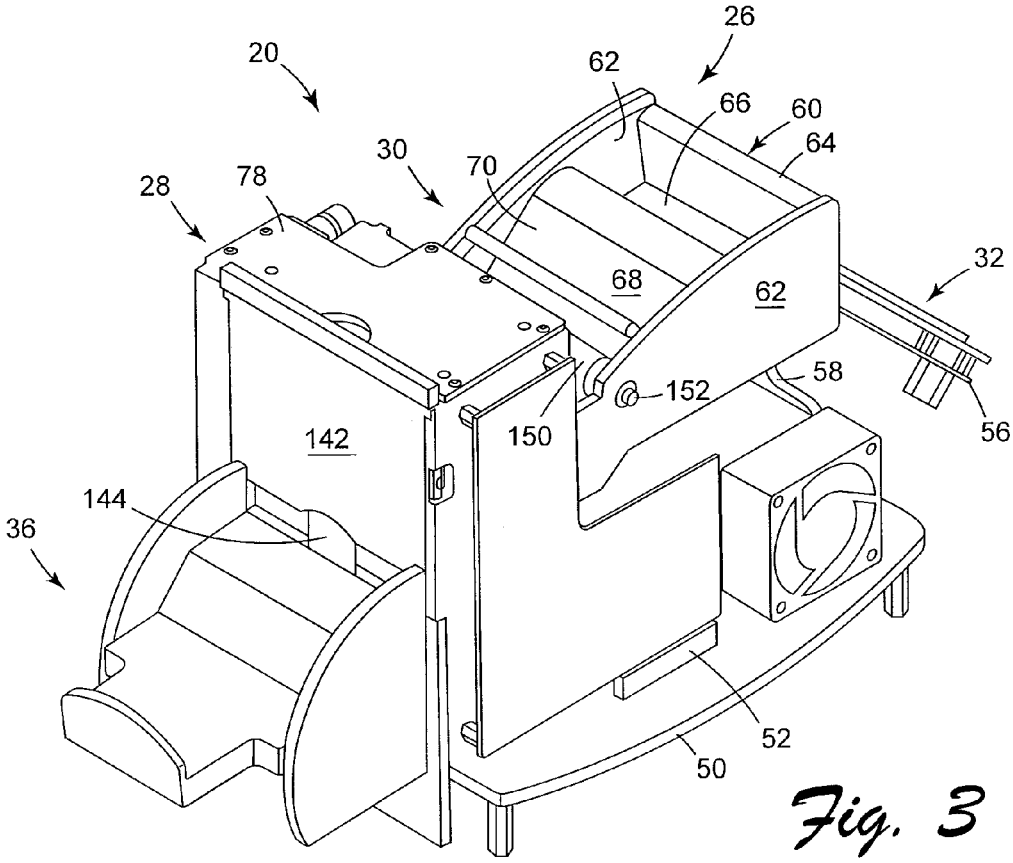
Fig. 3

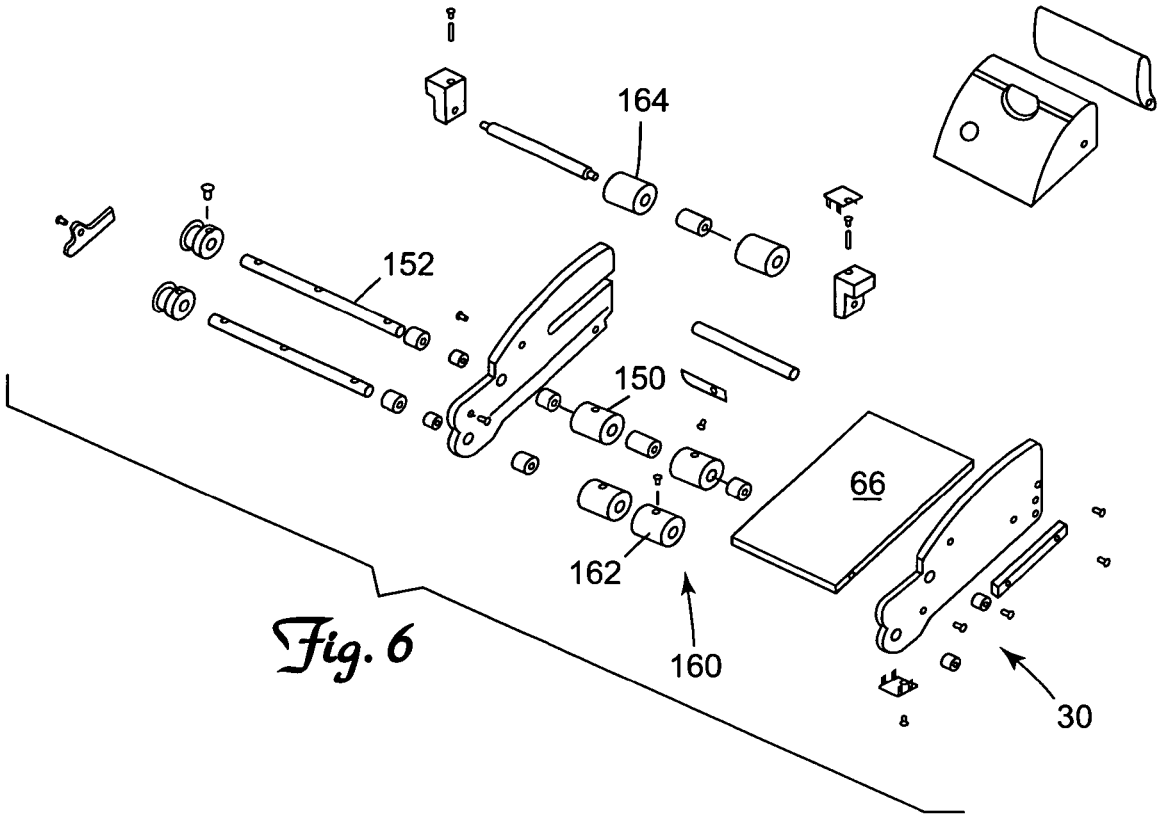
Fig. 6
Fig. 7
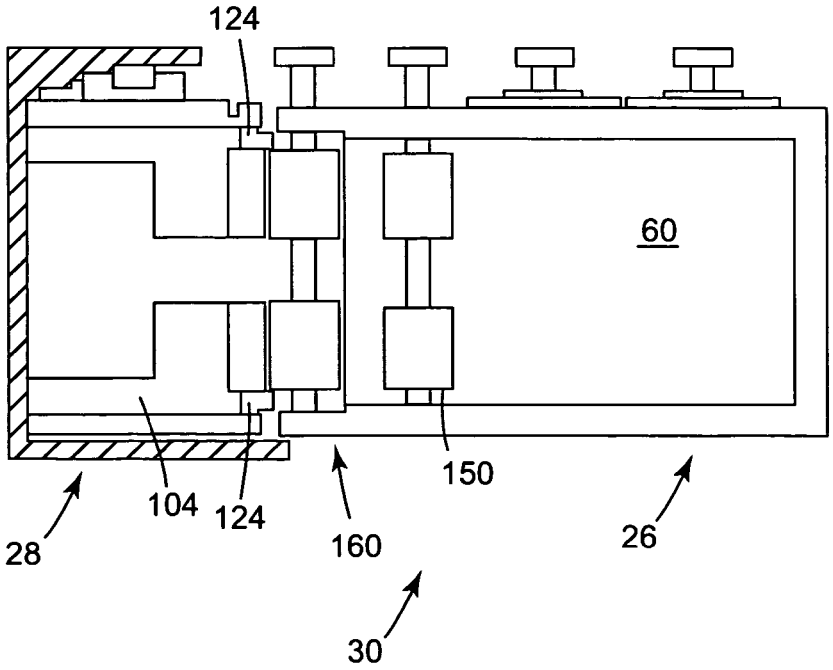

190
192
201
194
196
34
198

104
112
28
106
106
106
106
104
120
106
106
106
106
82
78
80

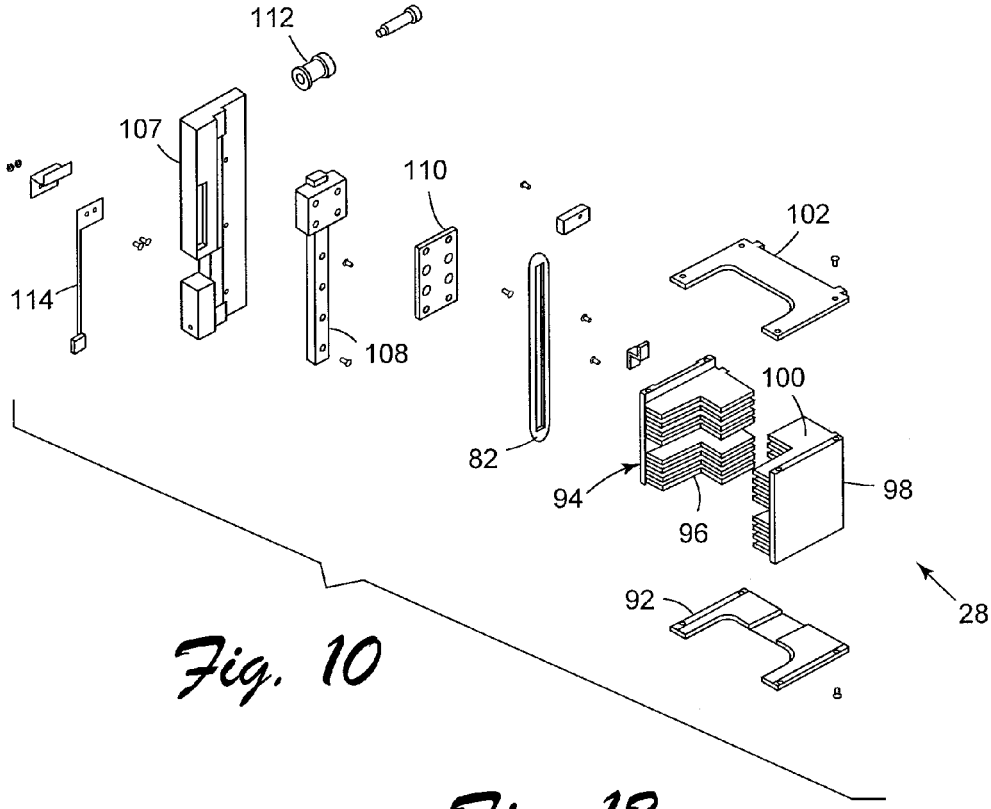
Fig. 10
Fig. 12
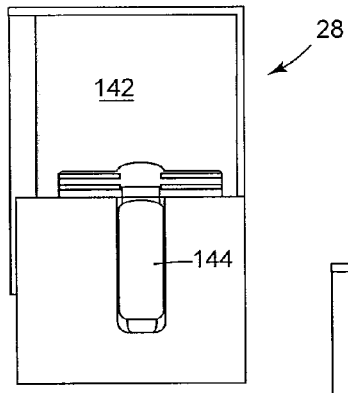
Fig. 11
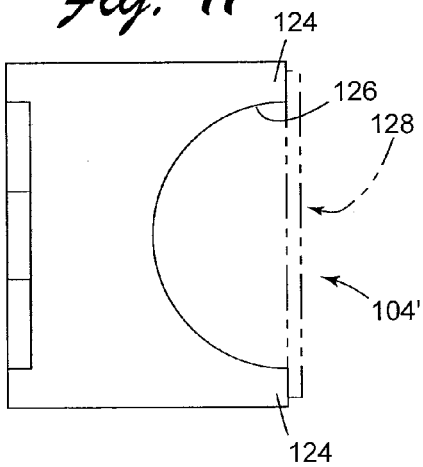
Fig. 13
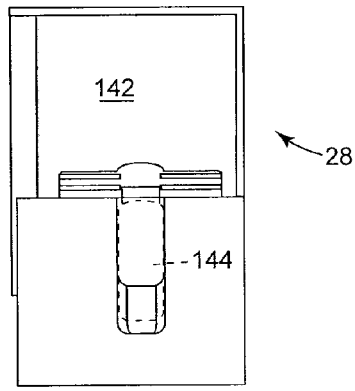

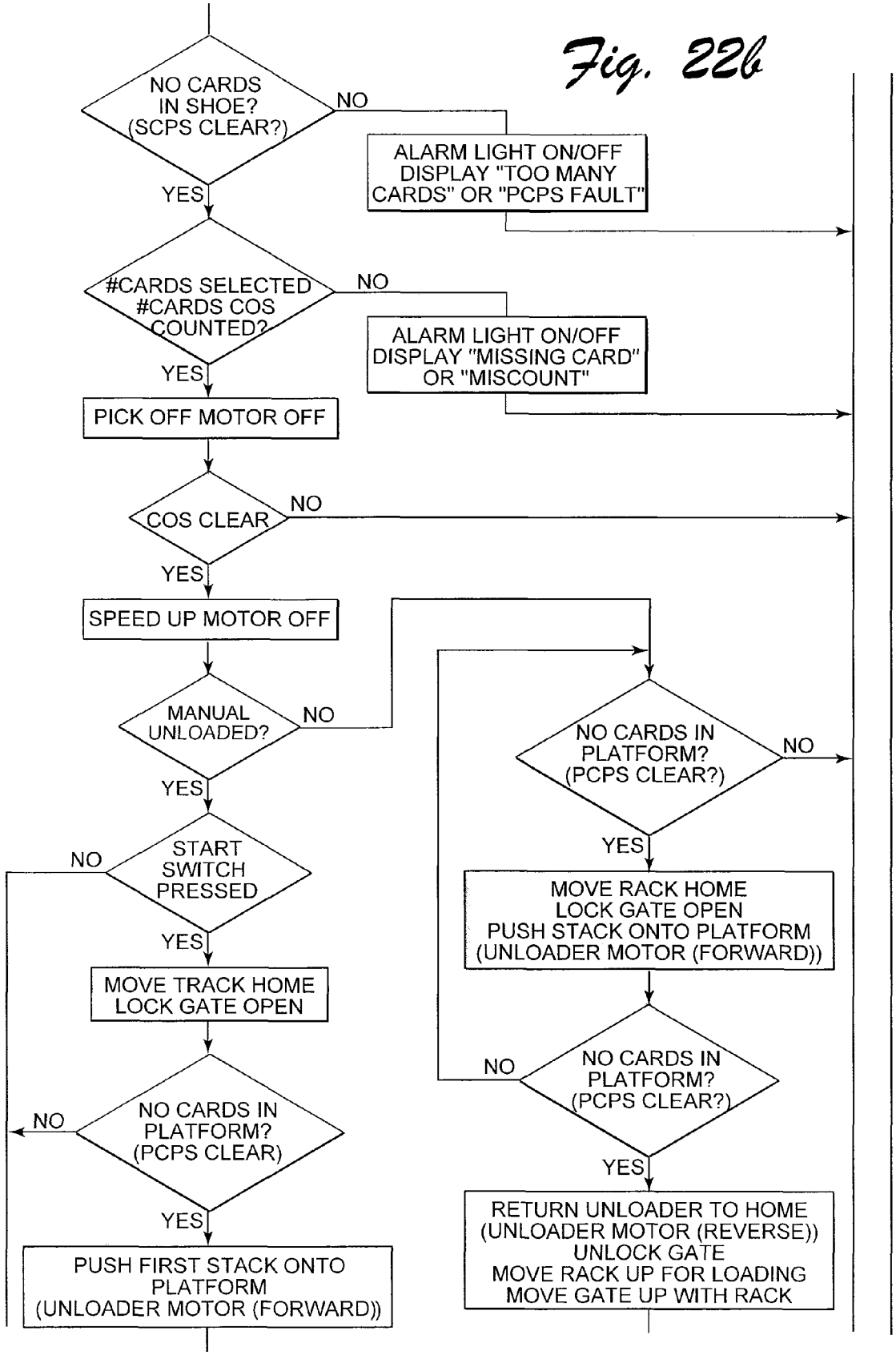
Fig. 22b
NO CARDS IN SHOE? (SCPS CLEAR?)
NO
ALARM LIGHT ON/OFF DISPLAY "TOO MANY CARDS" OR "PCPS FAULT"
YES
#CARDS SELECTED #CARDS COS COUNTED?
NO
ALARM LIGHT ON/OFF DISPLAY "MISSING CARD" OR "MISCOUNT"
YES
PICK OFF MOTOR OFF
COS CLEAR
NO
YES
SPEED UP MOTOR OFF
MANUAL UNLOADED?
NO
YES
START SWITCH PRESSED
NO
YES
MOVE TRACK HOME LOCK GATE OPEN
NO CARDS IN PLATFORM? (PCPS CLEAR)
NO
YES
PUSH FIRST STACK ONTO PLATFORM (UNLOADER MOTOR (FORWARD))
NO CARDS IN PLATFORM? (PCPS CLEAR?)
NO
YES
MOVE RACK HOME LOCK GATE OPEN PUSH STACK ONTO PLATFORM (UNLOADER MOTOR (FORWARD))
NO CARDS IN PLATFORM? (PCPS CLEAR?)
NO
YES
RETURN UNLOADER TO HOME (UNLOADER MOTOR (REVERSE)) UNLOCK GATE MOVE RACK UP FOR LOADING MOVE GATE UP WITH RACK

CARD FEED MECHANISMS FOR CARD-HANDLING APPARATUSES AND RELATED METHODS

CROSS-REFERENCE TO RELATED APPLICATIONS

This application is a continuation of U.S. patent application Ser. No. 11/365,935, filed Mar. 1, 2006, now U.S. Pat. No. 7,523,936, issued Apr. 28, 2009, which, in turn, is a continuation of U.S. patent application Ser. No. 10/725,833, filed Dec. 2, 2003, now U.S. Pat. No. 7,413,191, issued Aug. 19, 2008, which is a continuation of U.S. patent application Ser. No. 09/912,879, filed Jul. 25, 2001, now U.S. Pat. No. 6,655,684, issued Dec. 2, 2003, which is a continuation-in-part of U.S. patent application Ser. No. 09/688,597, filed Oct. 16, 2000, now U.S. Pat. No. 6,588,750, issued Jul. 8, 2003, which is a continuation-in-part of U.S. patent application Ser. No. 09/060,627, filed Apr. 15, 1998, now U.S. Pat. No. 6,149,154, issued Nov. 21, 2000.

TECHNICAL FIELD

The present invention relates to devices for handling cards, including cards known as "playing cards." In particular, the invention relates to an electromechanical machine for organizing or arranging playing cards into a plurality of hands, wherein each hand is formed as a selected number of randomly arranged cards. The invention also relates to a mechanism for feeding cards into a shuffling apparatus and also to a method of delivering individual hands from the apparatus to individual players or individual player positions.

BACKGROUND

Wagering games based on the outcome of randomly generated or selected symbols are well known. Such games are widely played in gaming establishments such as casinos and the wagering games include card games wherein the symbols comprise familiar, common playing cards. Card games such as twenty-one or blackjack, poker and variations of poker and the like are excellent card games for use in casinos. Desirable attributes of casino card games are that the games are exciting, they can be learned and understood easily by players, and they move or are played rapidly to a wager-resolving outcome.

From the perspective of players, the time the dealer must spend in shuffling diminishes the excitement of the game. From the perspective of casinos, shuffling time reduces the number of hands placed, reduces the number of wagers placed and resolved in a given amount of time, thereby reducing revenue. Casinos would like to increase the amount of revenue generated by a game without changing games, particularly a popular game, without making obvious changes in the play of the game that affect the hold of the casino, and without increasing the minimum size of wagers. One approach to speeding play is directed specifically to the fact that playing time is decreased by shuffling and dealing events. This approach has lead to the development of electromechanical or mechanical card-shuffling devices. Such devices increase the speed of shuffling and dealing, thereby increasing playing time. Such devices also add to the excitement of a game by reducing the time the dealer or house has to spend in preparing to play the game.

U.S. Pat. No. 4,513,969 to Samsel, Jr., and U.S. Pat. No. 4,515,367 to Howard disclose automatic card shufflers. The Samsel, Jr. patent discloses a card shuffler having a housing with two wells for receiving stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players. The Howard patent discloses a card mixer for randomly interleaving cards including a carriage-supported ejector for ejecting a group of cards (approximately two playing decks in number, which may then be removed manually from the shuffler or dropped automatically into a chute for delivery to a typical dealing shoe.

U.S. Pat. No. 4,586,712 to Lorber et al. discloses an automatic shuffling apparatus designed to intermix multiple decks of cards under the programmed control of a computer. The Lorber et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe.

U.S. Pat. No. 5,000,453 to Stevens et al. discloses an apparatus for automatically shuffling cards. The Stevens et al. machine includes three contiguous magazines with an elevatable platform in the center magazine only. Unshuffled cards are placed in the center magazine and the spitting rollers at the top of the magazine spit the cards randomly to the left and right magazines in a simultaneous cutting and shuffling step. The cards are moved back into the center magazine by direct lateral movement of each shuffled stack, placing one stack on top of the other to stack all cards in a shuffled stack in the center magazine. The order of the cards in each stack does not change in moving from the right and left magazines into the center magazine.

U.S. Pat. No. 3,897,954 to Erickson et al. discloses the concept of delivering cards one at a time into one of a number vertically stacked card-shuffling compartments. The Erickson patent also discloses using a logic circuit to determine the sequence for determining the delivery location of a card, and that a card shuffler can be used to deal stacks of shuffled cards to a player. U.S. Pat. No. 5,240,140 to Huen discloses a card dispenser which dispenses or deals cards in four discrete directions onto a playing surface, and U.S. Pat. Nos. 793,489 to Williams, 2,001,918 to Nevius, 2,043,343 to Warner, and 3,312,473 to Friedman et al. disclose various card holders, some of which include recesses (e.g., Friedman et al.) to facilitate removal of cards. U.S. Pat. Nos. 2,950,005 to MacDonald and 3,690,670 to Cassady et al. disclose card-sorting devices that require specially marked cards, clearly undesirable for gaming and casino play.

U.S. Pat. No. 4,770,421 to Hoffman discloses a card-shuffling device including a card-loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence that is fixed as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir. Thus, the Hoffman patent requires a two-step shuffle, i.e., a program is required to select the order in which stacks are loaded and moved onto the second elevator and delivers a shuffled deck or decks. The Hoffman patent does not disclose randomly selecting a location within the vertical stack for delivering each card. Nor does the Hoffman patent disclose a single-stage process that randomly delivers hands of shuffled cards with a degree of randomness satisfactory to casinos and players. Further, there is no disclosure in the Hoffman patent about how to deliver a preselected number of cards to a preselected number of hands ready for use by players or participants in a game. Another card-handling apparatus with an elevator is disclosed in U.S. Pat. No. 5,683,085 to Johnson et al. U.S. Pat. No. 4,750,743 to Nicoletti discloses a playing card dispenser including an inclined surface and a card pusher for urging cards down the inclined surface.

Other known card-shuffling devices are disclosed in U.S. Pat. Nos. 2,778,644 to Stephenson, 4,497,488 to Plevyak et al., 4,807,884 and 5,275,411 both to Breeding, and 5,695,189 to Breeding et al. The Breeding patents disclose machines for automatically shuffling a single deck of cards including a deck-receiving zone, a carriage section for separating a deck into two deck portions, a sloped mechanism positioned between adjacent corners of the deck portions, and an apparatus for snapping the cards over the sloped mechanism to interleave the cards.

The Breeding single-deck shufflers used in connection with LET IT RIDE® stud Poker are programmed to first shuffle a deck of cards, and then sequentially deliver hands of a preselected number of cards for each player. LET IT RIDE® stud poker is the subject of U.S. Pat. Nos. 5,288,081 and 5,437,462 to Breeding, which are herein incorporated by reference. The Breeding single-deck shuffler delivers three cards from the shuffled deck in sequence to a receiving rack. The dealer removes the first hand from the rack. Then, the next hand is automatically delivered. The dealer inputs the number of players, and the shuffler deals out that many hands plus a dealer hand. The Breeding single-deck shufflers are capable of shuffling a single deck and delivering seven player hands plus a dealer hand in approximately 60 seconds. The Breeding shuffler is a complex electromechanical device that requires tuning and adjustment during installation. The shufflers also require periodic adjustment. The Breeding et al. device, as exemplified in U.S. Pat. Nos. 6,068,258; 5,695,189; and 5,303,921 are directed to shuffling machines for shuffling multiple decks of cards with three magazines wherein unshuffled cards are cut then shuffled.

Although the devices disclosed in the preceding patents, particularly the Breeding machines, provide improvements in card-shuffling devices, none discloses or suggests a device and method for providing a plurality of hands of cards, wherein the hands are ready for play and wherein each comprises a randomly selected arrangement of cards, without first randomly shuffling the entire deck. A device and method which provides a plurality of ready-to-play hands of a selected number of randomly arranged cards at a greater speed than known devices without shuffling the entire deck or decks would speed and facilitate the casino play of card games.

U.S. Pat. No. 6,149,154 describes an apparatus for moving playing cards from a first group of cards into plural groups, each of the plural groups containing a random arrangement of cards, the apparatus comprising: a card receiver for receiving the first group of unshuffled cards; a single stack of card-receiving compartments generally adjacent to the card receiver, the stack generally adjacent to and movable with respect to the first group of cards; and a drive mechanism that moves the stack by means of translation relative to the first group of unshuffled cards; a card-moving mechanism between the card receiver and the stack; and a processing unit that controls the card-moving mechanism and the drive mechanism so that a selected quantity of cards is moved into a selected number of compartments.

SUMMARY OF THE INVENTION

The present invention provides an electromechanical card-handling apparatus and method for creating or generating a plurality of hands of cards from a group of unshuffled cards, wherein each hand contains a predetermined number of randomly selected or arranged cards. The apparatus and, thus, the card-handling method or process, is controlled by a programmable microprocessor and may be monitored by a plurality of sensors and limit switches.

While the card-handling apparatus and method of the present invention is well suited for use in the gaming environment, particularly in casinos, the apparatus and method may find use in homes, card clubs, or for handling or sorting sheet material generally.

In one embodiment, an apparatus moves playing cards from a first group of unshuffled cards into shuffled hands of cards, wherein at least one and usually all of the hands contains a random arrangement or random selection of a preselected number of cards. In one embodiment, the total number of cards in all of the hands is less than the total number of cards in the first group of unshuffled cards (e.g., one or more decks of playing cards). In another embodiment, all of the cards in the first group of unshuffled cards are distributed into hands.

The apparatus comprises a card receiver for receiving the first group of cards, a stack of card-receiving compartments (e.g., a generally vertical stack of horizontally disposed card-receiving compartments or carousel of rotating stacks) generally adjacent to the card receiver (the vertical stack generally is vertically movable and a carousel is generally rotatable), an elevator for raising and lowering the vertical stack or a drive to rotate the carousel, a card-moving mechanism between the card receiver and the card-receiving compartments for moving cards, one at a time, from the card receiver to a selected card-receiving compartment, and a microprocessor that controls the card-moving mechanism and the elevator or drive mechanism so that each card in the group of unshuffled cards is placed randomly into one of the card-receiving compartments. Sensors may monitor and may trigger at least certain operations of the apparatus, including activities of the microprocessor, card-moving mechanisms, security monitoring, and the elevator or carousel.

The controlling microprocessor, including software, randomly selects or identifies which slot or card-receiving compartment will receive each card in the group before card-handling operations begin. For example, a card designated as card 1 may be directed to a slot 5 (numbered here by numeric position within an array of slots), a card designated as card 2 may be directed to slot 7, a card designated as card 3 may be directed to slot 3, etc. Each slot or compartment may, therefore, be identified and treated to receive individual hands of defined numbers of randomly selected cards or the slots may be later directed to deliver individual cards into a separate hand-forming slot or tray. In the first example, a hand of cards is removed as a group from an individual slot. In the second example, each card defining a hand is removed from more than one compartment (where one or more cards are removed from a slot), and the individual cards are combined in a hand-receiving tray to form a randomized hand of cards.

Another feature of the present invention is that it provides a programmable card-handling machine with a display and appropriate inputs for adjusting the machine to any of a number of games wherein the inputs include one or more of a number of cards per hand or the name of the game selector, a number of hands delivered selector and a trouble-shooting input. Residual cards after all designated hands are dealt may be stored within the machine, delivered to an output tray that is part of the machine, or delivered for collection out of the machine, usually after all hands have been dealt and/or delivered. Additionally, there may be an elevator speed or carousel drive speed adjustment and position sensor to accommodate or monitor the position of the elevator or carousel as cards wear or become bowed or warped. These features also provide for interchangeability of the apparatus, meaning the same apparatus can be used for many different games and in different locations, thereby reducing the number of back-up machines or units required at a casino. The display may include a game mode or selected game display, and use a cycle rate and/or hand count monitor and display for determining or monitoring the usage of the machine.

Another feature of the present invention is that it provides an electromechanical playing card-handling apparatus for more rapidly generating multiple random hands of playing cards as compared to known devices. The preferred device may complete a cycle in approximately 30 seconds, which is double the speed (half the time) of the Breeding single-deck shuffler disclosed in U.S. Pat. No. 4,807,884, which has itself achieved significant commercial success. Although some of the groups of playing cards (including player and dealer hands and discarded or unused cards) arranged by the apparatus in accordance with the method of the present invention may contain the same number of cards, the cards within any one group or hand are randomly selected and placed therein. Other features of the invention include a reduction of setup time, increased reliability, lower maintenance and repair costs, and a reduction or elimination of problems such as card counting, possible dealer manipulation and card tracking. These features increase the integrity of a game and enhance casino security.

Yet another feature of the card-handling apparatus of the present invention is that it converts at least a single deck of unshuffled cards into a plurality of hands ready for use in playing a game. The hands converted from the at least a single deck of cards are substantially completely randomly ordered, i.e., the cards comprising each hand are randomly placed into that hand. To accomplish this random distribution, a preferred embodiment of the apparatus includes a number of vertically stacked, horizontally disposed card-receiving compartments one above another or a carousel arrangement of adjacent radially disposed stacks into which cards are inserted, one at a time, until an entire group of cards is distributed. In this preferred embodiment, each card-receiving compartment is filled (that is, filled to the assigned number of cards for a hand, with the residue of cards being fed into the discard compartment or compartments, or discharged from the apparatus at a card discharge port, for example), regardless of the number of players participating in a particular game.

For example, when the card-handling apparatus is being used for a seven-player game, at least seven player compartments, a dealer compartment and at least one compartment for cards not used in forming the random hands to be used in the seven-player game are filled. After the last card from the unshuffled group is delivered into these various compartments, the hands are ready to be removed from the compartments and put into play, either manually, automatically, or with a combined automatic feed and hand removal. For example, the cards in the compartments may be so disposed as they are removable by hand by a dealer (a completely manual delivery from the compartment), hands are discharged into a readily accessible region (e.g., tray or support) for manual removal (a combination of mechanical/automatic delivery and manual delivery), or hands are discharged and delivered to a specific player/dealer/discharge position (completely automatic delivery).

The device can also be readily adapted for games that deal a hand or hands only to the dealer, such as David Sklansky's HOLD 'EM CHALLENGE™ poker game, described in U.S. Pat. No. 5,382,025.

One type of device of the present invention may include jammed card detection and recovery features, and may include recovery procedures operated and controlled by the microprocessor.

Generally, the operation of the card-handling apparatus of the present invention will form at least a fixed number of hands of cards corresponding to the maximum number of players at a table, optionally plus a dealer hand (if there is a dealer playing in the game), and usually a discard pile. For a typical casino table having seven player stations, the device of the present invention would preferably have at least or exactly nine compartments (if there are seven players and a dealer) or at least or exactly eight compartments (if there are seven players and no dealer playing in the game) that are actually utilized in the operation of the apparatus in dealing a game, wherein each of seven player compartments contains the same number of cards. Depending upon the nature of the game, the compartments for the dealer hand may have the same or different number of cards as the player compartments, and the discard compartment may contain the same or different number of cards as the player compartments and/or the dealer compartment, if there is a dealer compartment. However, it is most common for the discard compartment to contain a different number of cards than the player and/or dealer compartments and examples of the apparatus having this capability enables play of a variety of games with a varying number of players and/or a dealer. In another example of the invention, more than nine compartments are provided and more than one compartment can optionally be used to collect discards. Providing extra compartments also increases the possible uses of the machine. For example, a casino might want to use the shuffler for an eight-player over-sized table.

Most preferably, the device is programmed to deliver a fixed number of hands, or deliver hands until the dealer (whether playing in the game or operating as a house dealer) presses an input button. The dealer input tells the microprocessor that the last hand has been delivered (to the players or to the players and dealer), and then the remaining cards in the compartments (excess player compartments and/or discard compartment and/or excess card compartment) will be unloaded into an output or discard compartment or card collection compartment outside the shuffler (e.g., where players' hands are placed after termination or completion of play with their hands in an individual game). The discard, excess or unused card hand (i.e., the cards placed in the discard compartment or slot) may contain more cards than player or dealer hand compartments and, thus, the discard compartment may be larger than the other compartments. In a preferred embodiment, the discard compartment is located in the middle of the generally vertically arranged stack of compartments. In another example of the invention, the discard compartment or compartments are of the same size as the card-receiving compartments. The specific compartment(s) used to receive discards or cards can also change from shuffle to shuffle.

Another feature of the invention is that the apparatus of the present invention may provide for the initial top feeding or top loading of an unshuffled group of cards, thereby facilitating use by the dealer. The hand-receiving portion of the machine may also facilitate use by the dealer, by having cards displayed or provided so that a dealer is able to conveniently remove a randomized hand from the upper portion of the machine or from a tray, support or platform extending from the machine to expose the cards to a vertical or nearly vertical access (within 0 degrees to 30 degress or 50 degrees of horizontal, for example) by the dealer's hand.

An additional feature of the card handling apparatus of the present invention is that it facilitates and significantly speeds the play of casino wagering games, particularly those games calling for a certain, fixed number of cards per hand (e.g., CARIBBEAN STUD® poker, LET IT RIDE® poker, Pai Gow Poker, TRES CARD™ poker, THREE CARD POKER®, HOLD 'EM CHALLENGE™ poker, stud poker games, wild card poker games, match card games, and the like), making the games more exciting and less tedious for players, and more profitable for casinos. The device of the present invention is believed to deliver random hands at an increased speed compared to other shufflers, such as approximately twice the speed of known devices.

In use, the apparatus of the present invention is operated to process playing cards from an initial, unshuffled or used group of cards into a plurality of hands, each hand containing the same number of randomly arranged cards. If the rules of the game require delivery of hands of unequal numbers of cards, the device of the present invention could be programmed to distribute the cards according to any preferred card count. It should be understood that the term "unshuffled" is a relative term. A deck is unshuffled a) when it is being recycled after play and b) after previous mechanical or manual shuffling before a previous play of a game, as well as c) when a new deck is inserted into the machine with or without ever having been previously shuffled, either manually or mechanically. The first step of this process is affected by the dealer placing the initial group of cards into a card receiver of the apparatus. The apparatus is started and, under the control of the integral microprocessor, assigns each card in the initial group to a compartment (randomly selecting compartments separately for each card), based on the selected number of hands, and a selected number of cards per hand. Each hand is contained in a separate compartment of the apparatus, and each is delivered (upon the dealer's demand or automatically) by the apparatus from that compartment to a hand receiver, hand support or hand platform, either manually or automatically, for the dealer to distribute it to a player. The number of hands created by the apparatus within each cycle is preferably selected to correspond to the maximum number of hands required to participate in a game (accounting for player hands, dealer hands, or house hands), and the number or quantity of cards per hand is programmable according to the game being played.

The machine can also be programmed to form a number of hands corresponding to the number of players at the table. The dealer could be required to input the number of players at the table. The dealer would be required to input the number of players at the table, at least as often as the number of players change. The keypad input sends a signal to the microprocessor and then the microprocessor in turn controls the components to produce only the desired number of hands. Alternatively, bet sensors are used to sense the number of players present. The game controller communicates the number of bets placed to the shuffler, and a corresponding number of hands are formed.

Each time a new group of unshuffled cards, hand shuffled cards, used cards or a new deck(s) of cards is loaded into the card receiver and the apparatus is activated, the operation of the apparatus involving that group of cards, i.e., the forming of that group of cards into hands of random cards, comprises a new cycle. Each cycle is unique and is effected by the microprocessor, which microprocessor is programmed with software to include random number generating capability. The software assigns a card number to each card and then randomly selects or correlates a compartment to each card number. Under the control of the microprocessor, the elevator or carousel aligns the selected compartment with the card feed mechanism in order to receive the next card. The software then directs each numbered card to the selected slots by operating the elevator or carousel drive to position that slot to receive a card.

The present invention also describes an alternative and optional unique method and component of the system for aligning the feed of cards into respective compartments and for forming decks of randomly arranged cards. The separators between compartments may have an edge facing the direction from which cards are fed, that edge having two acute angled surfaces (away from parallelism with the plane of the separator) so that cards may be deflected in either direction (above/below, left/right, top/bottom) with respect to the plane of the separator. When there are already one or more cards within a compartment, such deflection by the edge of the separator may insert cards above or below the card(s) in the compartment. The component that directs, moves, and/or inserts cards into the compartments may be controllably oriented to direct a leading edge of each card toward the randomly selected edge of a separator so that the card is inserted in the randomly selected compartment and in the proper orientation (above/below, left/right, top/bottom) with respect to a separator, the compartments, and card(s) in the compartments.

The apparatus of the present invention is compact, easy to set up and program and, once programmed, can be maintained effectively and efficiently by minimally trained personnel who cannot affect the randomness of the card delivery. This means that the machines are more reliable in the field. Service costs are reduced, as are assembly costs and setup costs. The preferred device also has fewer parts, which should provide greater reliability than known devices.

Another optional feature of the present invention is to have all compartments of equal size and fed into a final deck-forming compartment so that the handling of the cards effects a shuffling of the deck, without creating actual hands for play by players and/or the dealer. The equipment is substantially similar, with the compartments that were previously designated as hands or discards, having the cards contained therein subsequently stacked to form a shuffled deck(s). Another feature of the present invention is a mechanism that feeds cards into the compartments with a high rate of accuracy and that minimizes or eliminates wear on the cards, extending the useful life of the cards. The mechanism comprises a feed roller that remains in contact with the moving card (and possibly the subsequently exposed, underlying card) as cards are moved toward the second card-moving system (e.g., a pair of speed-up rollers), but advantageously disengages from the contact roller drive mechanism when a leading edge of the moving card contacts or is grasped and moved forward by the second card-moving system. Other features and advantages of the present invention will become more fully apparent and understood with reference to the following specification and to the appended drawings and claims.

BRIEF DESCRIPTION OF THE DRAWINGS

FIG. 2 is a rear perspective view depicting an apparatus of the present invention.

FIG. 3 is a front perspective view of a card-handling apparatus of the present invention with an exterior shroud removed.

FIG. 6 is an exploded assembly view of the card-trasporting mechanism.

FIG. 7 is a top plan view, partially in section, of the transport mechanism.

FIG. 10 is an exploded view of the rack and elevator assembly.

FIG. 11 depicts an alternative embodiment of the shelves or partitions for forming the stack of compartments of the present invention.

FIG. 12 depicts the card stop in an open position.

FIG. 13 depicts the card stop in a closed position.

DETAILED DESCRIPTION OF THE INVENTION

Figure 1:
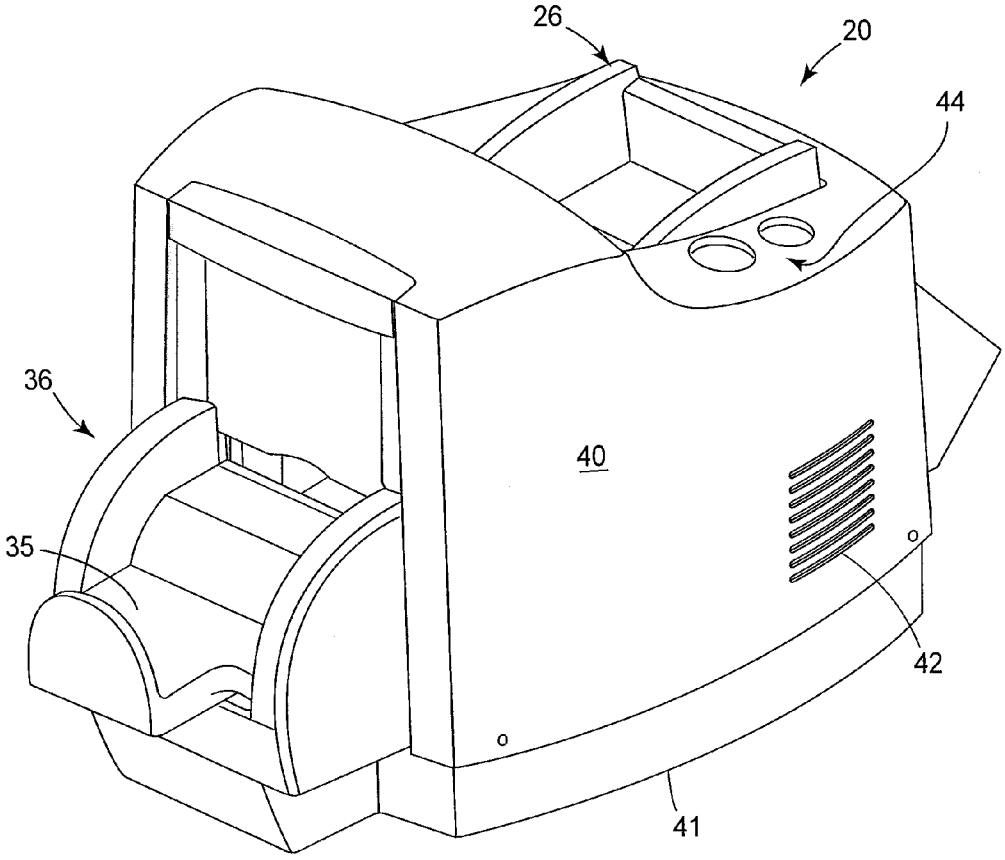
FIG. 1 is a front perspective view depicting an apparatus of the present invention as it might be disposed ready for use in a casino on a gaming table.

This detailed description is intended to be read and understood in conjunction with appended Appendices A, B and C, which are incorporated herein by reference. Appendix A provides an identification key correlating the description and abbreviation of certain non-limiting examples of motors, switches and photo eyes or sensors with reference character identifications of the same components in the figures, and gives the manufacturers, addresses and model designations of certain components (motors, limit switches and sensors). Appendix B outlines steps in a homing sequence, part of one embodiment of the sequence of operations as outlined in Appendix C. With regard to mechanisms for fastening, mounting, attaching or connecting the components of the present invention to form the apparatus as a whole, unless specifically described as otherwise, such mechanisms are intended to encompass conventional fasteners such as machine screws, rivets, nuts and bolts, toggles, pins and the like. Other fastening or attachment mechanisms appropriate for connecting components include adhesives, welding and soldering, the latter particularly with regard to the electrical system of the apparatus.

All components of the electrical system and wiring harness of the present invention may be conventional, commercially available components unless otherwise indicated, including electrical components and circuitry, wires, fuses, soldered connections, chips, boards, microprocessors, computers, and control system components. The software may be developed simply by hired programming without undue experimentation, the software merely directing physical performance without unique software functionality.

Generally, unless specifically otherwise disclosed or taught, the materials for making the various components of the present invention are selected from appropriate materials such as metal, metallic alloys, ceramics, plastics, fiberglass, composites, and the like.

In the following description, the Appendices and the claims, any references to the terms right and left, top and bottom, upper and lower and horizontal and vertical are to be read and understood with their conventional meanings and with reference to viewing the apparatus from whatever convenient perspective is available to the viewer, but generally from the front as shown in perspective in FIG. 1.

One method according to the present invention relates to a card delivery assembly or subcomponent that comprises a preliminary card-moving element that temporarily disengages or stops its delivery action or card control action upon sensing or as a result of a card coming into contact with a second card-moving or card-delivery element, component or subcomponent, or in response to an increase in linear speed of the card. That is, a first card-moving component moves individual cards from a first location (e.g., the card-receiving stack) toward a second card-moving element or subcomponent (e.g., a set of speed-up rollers) and the second card-moving element places the cards in a compartment after the card delivery assembly is brought into alignment with a selected component. When the second card-moving element, component or subcomponent intercepts an individual card or begins to grasp, guide or move an individual card, the first card-moving element, component or subcomponent must disengage its card-moving action to prevent that card-moving action from either jamming the apparatus, excessively directing or controlling an individual card, or moving too many cards (e.g., more than one card) at the same time.

A general method of the invention provides for randomly mixing cards comprising:

a) providing at least one deck of playing cards;

b) removing cards one at a time from the at least one deck of cards;

c) randomly inserting each card removed one at a time into one of a number of distinct storage areas, each storage area defining a distinct subset of cards; and d) at least one of the storage areas receives at least two randomly inserted cards one at a time to form a random, distinct subset of at least two cards.

Cards in random, distinct subsets may be removed from at least one of the distinct storage areas.

The cards removed from at least one of the distinct storage areas may define a subset of cards that is delivered to a player as a hand. One set of the cards removed from at least one of the distinct storage areas may also define a subset of cards that is delivered to a dealer as a hand. Distinct subsets of cards may be removed from at least one distinct storage area and be delivered into a receiving area. Each distinct subset of cards may be removed from the storage area and delivered to a position on a gaming table that is distinct from a position where another removed subset is delivered. All removed subsets may be delivered to the storage area without removal of previous subsets being removed from the receiving area. At least one received subset may become a hand of cards for use in a game of cards. The subsets may be delivered one at a time to a subset delivery position or station (e.g., delivery tray, delivery support, delivery container or delivery platform). The hands are delivered from the subset compartments, either by moving cards from the subset compartment one at a time, multiple cards at a time, or complete subsets at a single time. Moving single cards at a time can be accomplished with pick-off rollers, for example. The movement of a complete subset of cards can be accomplished by pushing the group out of the compartment with a pushing mechanism, as described below in the section entitled "Second Card-Moving Mechanism."

Figure 4:
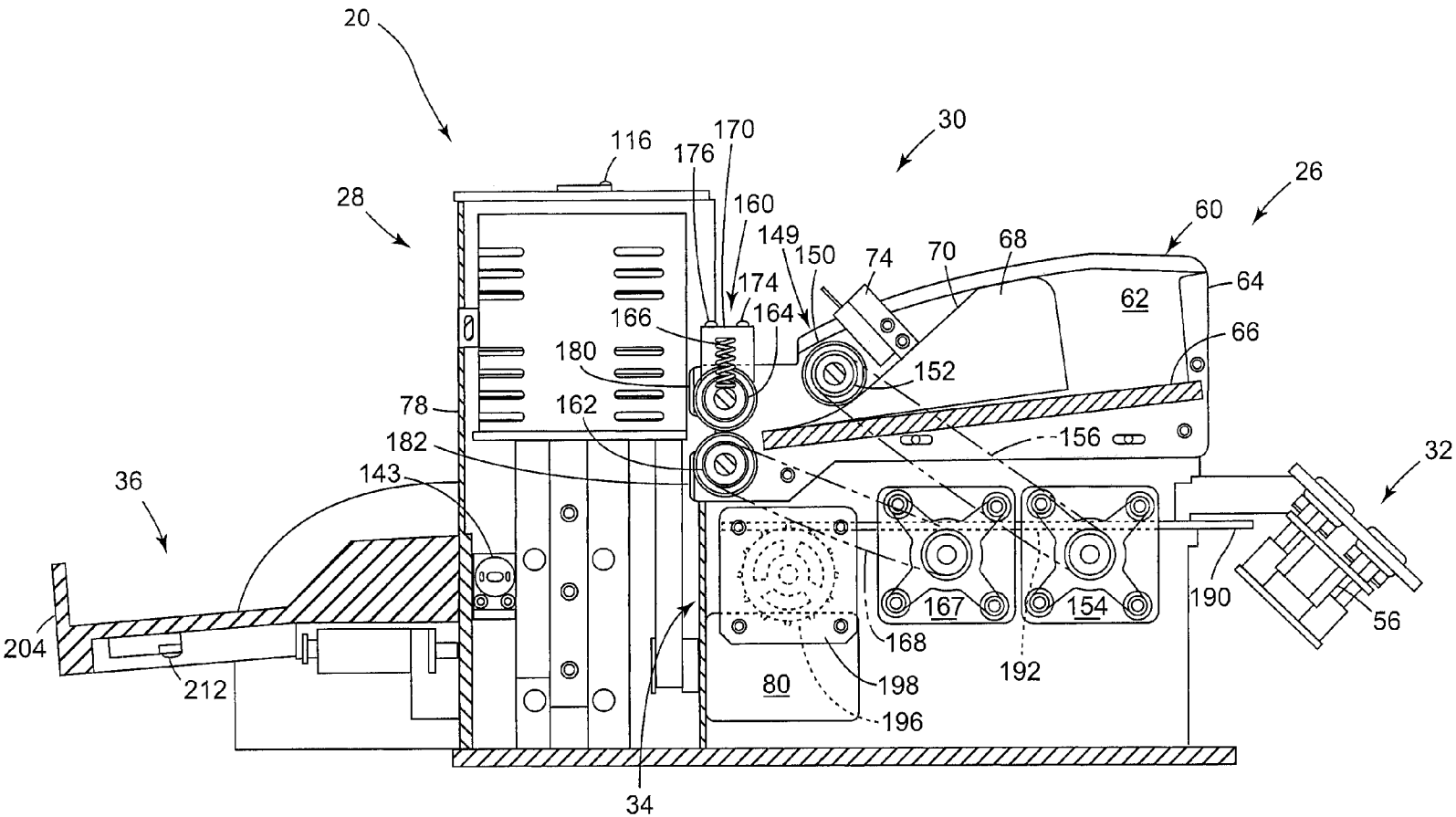
FIG. 4 is a side elevation view of the present invention with the shroud and other portions of the apparatus removed to show internal components.

Referring to the figures, particularly FIGS. 1, 3 and 4, the card-handling apparatus 20 of the present invention includes a card receiver 26 for receiving a group of cards, a single stack of card-receiving compartments 28 (see FIGS. 3 and 4) generally adjacent to the card receiver 26, a card-moving or card-transporting mechanism 30 between and linking the card receiver 26 and the compartments 28, and a processing unit, indicated generally at 32, that controls the apparatus 20. The apparatus 20 includes a second card mover 34 (see FIG. 4) for emptying the compartments 28 into a second receiver 36.

Referring now to FIG. 1, the card-handling apparatus 20 includes a removable, substantially continuous exterior housing, casing or shroud 40. The exterior design features of the device of the present invention are disclosed in U.S. Design Pat. No. D414,527. The casing or shroud 40 may be provided with appropriate vents 42 for cooling, if needed. The card receiver or initial loading region, indicated generally at 26, is at the top, rear of the apparatus 20, and a deck-, card- or hand-receiving platform 36 is at the front of the apparatus 20. The platform 36 has a surface 35 for supporting a deck, card or hand. The surface 35 allows ready access by a dealer or player to the deck, card or hand, handled, shuffled or discharged by the apparatus 20. Surface 35, in one example of the present invention, lies at an angle with respect to the base 41 of the apparatus 20. That angle is preferably approximately 5 degrees with respect to the horizontal, but may also conveniently be at an angle of from 0 to up to ±60 degrees with respect to the base 41, to provide convenience and ergonomic considerations to the dealer. Controls and/or display features 44 are generally located toward the rear or dealer-facing end of the machine 20. FIG. 2 provides a perspective view of the rear of the apparatus 20 and more clearly shows the display 44A and control inputs 44, including a power input module 45, power switch 45A and a communication port 45B.

FIG. 3 depicts the apparatus 20 with the shroud 40 removed, as it might be for servicing or programming, whereby the internal components may be visualized. The apparatus 20 is shown as including a generally horizontal frame floor 50 and internal frame supports 52 for mounting and supporting operational components upright. A control (input and display) module 56 is cantilevered at the rear of the apparatus 20, and is operably connected to the operational portions of the apparatus 20 by suitable wiring 58. The inputs and display portion 44, 44A of the control module 56 are fitted to corresponding openings in the shroud 40, with associated circuitry and programming inputs located securely within the shroud 40 when it is in place as shown in FIGS. 1 and 2.

Card Receiver

The card-loading region 26 includes a card-receiving well 60. The well 60 is defined by upright, generally parallel card-guiding sidewalls 62 (although one or both walls may be sloped inwardly to guide the cards into position within the well) and a rear wall 64. The card-loading region includes a floor surface 66 which, in one example of the present invention, is preferably pitched or angled downwardly toward the front of the apparatus 20. Preferably, the floor surface 66 is pitched from the horizontal at an angle ranging from approximately 5 to 20 degrees, with a pitch of about 7 degrees being preferred. A removable, generally rectangular weight or block 68 is generally freely movably received in the well 60 for free forward and rearward movement along the floor surface 66. Under the influence of gravity, the block 68 will tend to move toward the forward end of the well 60. The block 68 has an angled, card-contacting front face 70 for contacting the face (i.e., the bottom of the bottommost card) of the last card in a group of cards placed into the well, and urges cards (i.e., the top card of a group of cards) forward into contact with the card-transporting mechanism 30. The card-contacting face 70 of the block 68 is at an angle complementary to the floor surface 66 of the well 60, for example, an angle of between approximately 10 and 80 degrees, and this angle and the weight of the block 68 keep the cards urged forwardly against the card-transporting mechanism 30. In one embodiment, card-contacting face 70 is rough and has a high coefficient of friction. The selected angle of the floor 66 and the weight of the block 68 allow for the free-floating rearward movement of the cards and the block 68 to compensate for the forces generated as the transport mechanism 30 contacts the front card to move it. In another embodiment, a spring is provided to maintain tension against block 68. As shown in FIG. 4, the well 60 includes a card present sensor 74 to sense the presence or absence of cards in the well 60. Preferably, the block 68 is mounted on a set of rollers 69 (FIG. 5), which allows the block to glide more easily along floor surface 66 and/or the floor surface 66 and floor-contacting bottom of the block 68 may be formed of or coated with suitable low friction materials.

Card-Receiving Compartments

Figure 9:
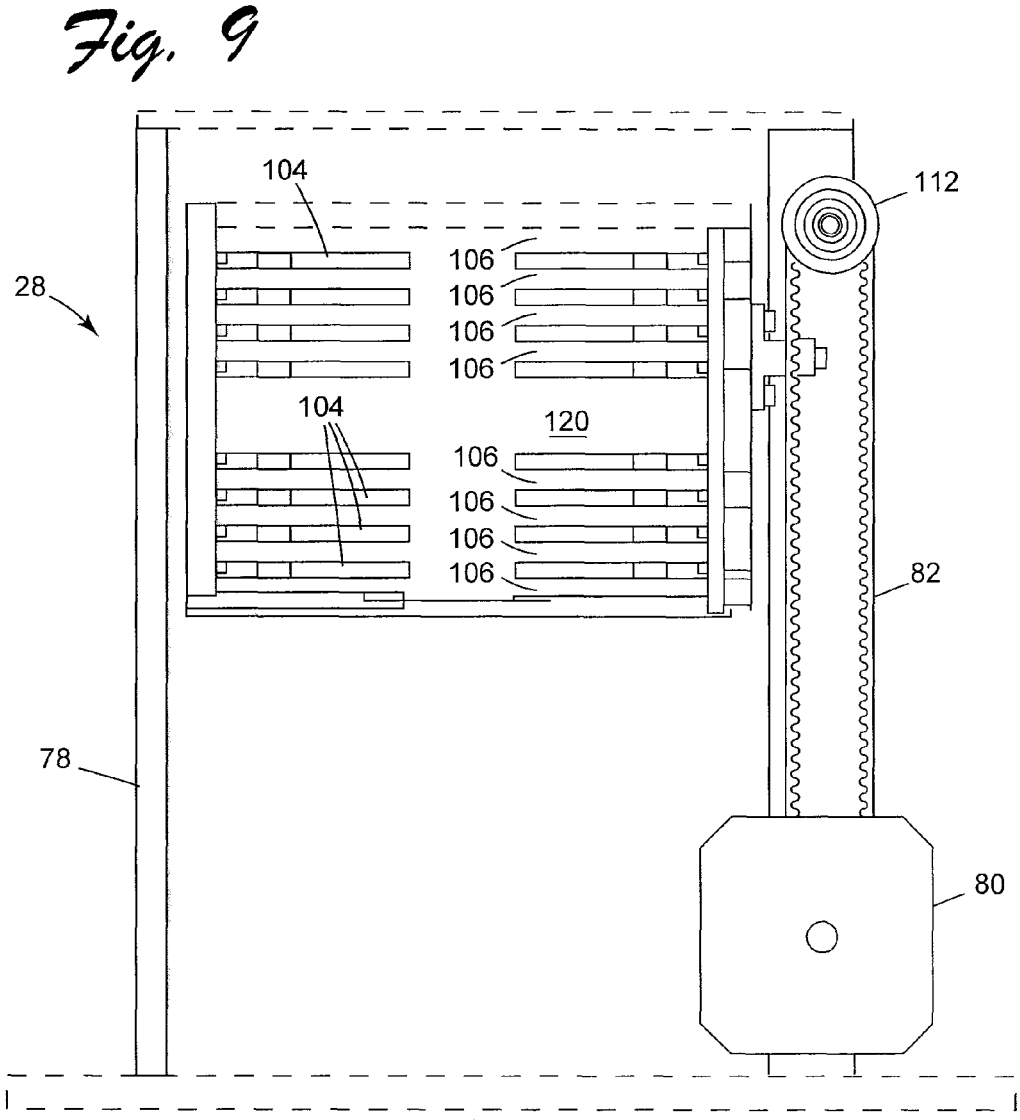
FIG. 9 is a front elevation view of a first rack and elevator assembly of the present invention.

A first preferred assembly or stack of card-receiving compartments 28 is depicted in FIGS. 9 and 10, and for purposes of this disclosure, this stack of card-receiving compartments is also referred to as a rack assembly or rack 28. The rack assembly 28 is housed in an elevator and rack assembly housing 78 generally adjacent to the well 60, but horizontally spaced therefrom (see FIG. 4). An elevator motor 80 is provided to position the rack assembly 28 vertically under control of a microprocessor, which microprocessor is generally part of the module 32 (see FIGS. 3 and 4). The elevator motor 80 is linked to the rack assembly 28 by a timing belt 82. Referring now to FIG. 10, the rack assembly 28 includes a bottom plate 92, a left hand rack 94 carrying a plurality of half shelves 96, a right hand rack 98 including a plurality of half shelves 100 and a top plate 102. Together, the right- and left-hand racks 94, 98 and their respective half shelves 96, 100, form the individual plate-like shelf pieces 104 for forming the top and bottom walls of individual compartments 106. Not shown are carousel or partial carousel or fan arrangements of card- or hand-receiving compartments. A carousel arrangement of card-receiving stacks or compartments, as known in the art, is a circular arrangement of compartments, with the compartments arranged in about 350 degrees to 360 degrees, with from five to 52 or more compartments in the carousel. A partial carousel or fan arrangement would be a segment of a carousel (e.g., 30 degrees of a circle, 45 degrees, 60 degrees, 75 degrees, 90 degrees, 110 degrees, 120 degrees, 145 degrees, 180 degrees or more or less, with compartments distributed within the segment. This arrangement has an advantage over the carousel of enabling lower space or lower volumes for the card-receiving compartments as a semicircle takes up less space than a complete carousel. Rather than rotating 360 degrees (or having a ±180 degree alternating movement capability), the partial carousel or fan arrangement may not need to rotate 360 degrees, and may alternatively rotate ±one-half the total angular distribution of the partial carousel or fan. For example, if the partial carousel covers only sixty degrees of a circular carousel, the partial carousel needs to have a rotational capability of only about ±30 degrees from the center of the partial carousel to enable access to all compartments. In other words, it could be capable of rotating in two directions, reducing the distance in which the carousel must travel to distribute cards.

Preferably, a vertical rack assembly 28 or the carousel or partial carousel assembly (not shown) has nine compartments 106. Seven of the nine compartments 106 are for forming player hands, one compartment 106 forms dealer hands and the last compartment 106 is for accepting unused or discard cards. It should be understood that the device of the present invention is not limited to a rack assembly 28 with seven compartments 106. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. Also, additional compartments may be provided to form hands for a gaming table having more than seven player positions. For example, some card rooms and casinos offer stud poker games for up to twelve people at a single table. The apparatus 20 may then have thirteen or more compartments, as traditional poker does not permit the house to play, with one or more compartments dedicated to collect unused cards. In one example of the invention, thirteen compartments are provided, and all compartments not used to form hands receive discard cards. For example, in a game in which seven players compete with a dealer, eight compartments are used to form hands and the five remaining compartments accept discards.

In each example of the present invention, at least one stack of unused cards is formed, which may not be sufficiently randomized for use in a card game. These unused cards should be combined if necessary, with the cards used in game play and returned to the card receiver for distribution in the next cycle.

The rack assembly 28 is operably mounted to the apparatus 20 by a left-side rack plate 107 and a linear guide 108. The rack assembly 28 is attached to the linear guide 108 by means of a guide plate 110. The timing belt 82 is driven by the motor 80 and engages a pulley 112 for driving the rack assembly 28 up and down. A Hall-effect switch assembly 114 is provided to sense the location of the rack assembly 28. The rack assembly 28 may include a card present sensor 116 mounted to an underside of plate 78 (see FIG. 4), which is electrically linked to the microprocessor.

FIG. 9 depicts a rack assembly 28 having nine individual compartments 106 including a comparatively larger, central compartment 120 for receiving discard or unused cards. A larger discard rack is shown in this example because in a typical casino game, either three or five cards are delivered to seven players and optionally a dealer, leaving from 12 to 28 discards. In other examples of the invention, multiple discard racks of the same configuration and size as hand-forming compartments are provided instead of a larger discard rack. FIG. 7 provides a top plan view of one of the shelf members 104 and shows that each includes a pair of rear tabs 124. The rear tabs 124 align a leading edge of the card with the opening of the compartment 106 (FIG. 9) so that the cards are moved from the card-transporting mechanism 30 into the rack assembly 28 without jamming.

FIG. 11 depicts an alternative embodiment of plate-like shelf members 104 comprising a single-piece plate member 104'. An appropriate number of the single-piece plates, corresponding to the desired number of compartments 106 are connected between the sidewalls of the rack assembly 28. The plate 104' depicted in FIG. 11 includes a curved or arcuate edge portion 126 on the rear edge 128 for removing cards or clearing jammed cards, and also includes the two bilateral tabs 124, also a feature of the shelf members 104 of the rack assembly 28 depicted in FIG. 7. The tabs 124 act as card guides and permit the plate-like shelf members 104 (FIG. 9) forming the compartments 106 to be positioned effectively as closely as possible to the card-transporting mechanism 30 to ensure that cards are delivered into the selected compartment 106 (or 120) even though they may be warped or bowed.

Referring back to FIG. 5, an advantage of the plate-like members 104 (and/or the half plates 96, 100) forming the compartments 106 is depicted. Each plate 104 includes a beveled or angled, underside rearmost surface 130 in the space between the shelves or plates 104, i.e., in each compartment 106, 120. The distance between the forward edge 132 of the beveled surface 130 and the forward edge 134 of a shelf 104 preferably is less than the width of a typical card. As shown in FIG. 5A, the leading edge 136 of a card being driven into a compartment 106, 120 hits the beveled surface 130 and is driven onto the top of the stack of cards supported by next shelf member 104. As shown in FIG. 5B, when the cards are fully inserted, a trailing edge 133 of each card is positioned between forward edge 132 and leading edge 136. To facilitate forming a bevel 130 at a suitable angle 135 and of a suitable size, a preferred thickness 137 for the plate-like shelf members is approximately 3/32 of an inch, but this thickness and/or the bevel angle can be changed or varied to accommodate different sizes and thicknesses of cards, such as poker and bridge cards. Preferably, the bevel angle 135 is between 10 degrees and 45 degrees, and most preferably between approximately 15 degrees and 20 degrees. Whatever bevel angle and thickness is selected, it is preferred that cards should come to rest with their trailing edge 133 rearward of the forward edge 132 of the beveled surface 130 (see FIG. 5B).

Referring now to FIGS. 12 and 13, the front portion of the rack assembly 28 includes a solenoid or motor-operated gate 144 and a door (card stop) 142 for controlling the unloading of the cards into the second receiver 36. Although a separate, vertically movable gate 144 and card door stop 142 are depicted, the function, stopping the forward movement of the cards, could be accomplished either by a lateral moving gate or card stop alone (not shown) or by other means. In FIG. 12, the gate 144 is shown in its raised position and FIG. 13 depicts it in its lowered open position. The position of the gate 144 and door stop 142 is related by the microprocessor to the rack assembly 28 position.

Card-Moving Mechanism

Figure 5:
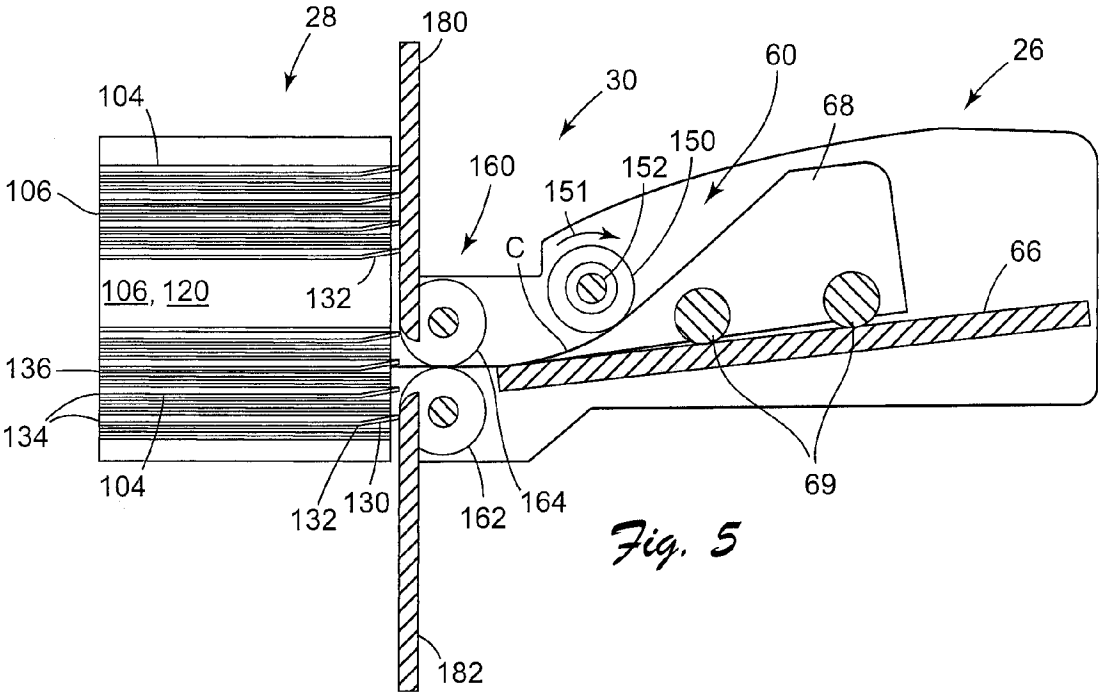
FIG. 5 is a side elevation view, largely representational, of a card-trasporting mechanism of the apparatus of the present invention.
Figure 5B:
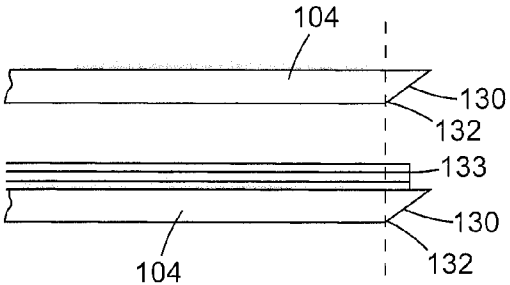
FIG. 5B is a cross-sectional view of a shelf with cards fully inserted.
Figure 5A:
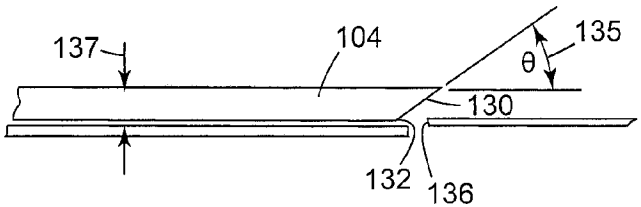
FIG. 5A is a detailed cross-sectional view of a shelf of one example of the invention.

Referring now to FIGS. 4, 5 and 6, a preferred card-transporting or card-moving mechanism 30 is positioned between the card-receiving well 60 and the compartments 106, 120 of the rack assembly 28 and includes a card pick-up roller assembly 149. The card pick-up roller assembly 149 includes a pick-up roller 150 and is located generally at the forward portion of the well 60. The pick-up roller 150 is supported by a bearing-mounted axle 152 extending generally transversely across the well 60 whereby the card-contacting surface of the roller 150 is in close proximity to the forward portion of the floor surface 66. The roller 150 is driven by a pick-up motor 154 operably coupled to the axle 152 by a suitable continuous connector 156 such as a belt or chain. In operation, the front card in the well 60 is urged against the roller 150 by block 68 so that when the roller 150 is activated, the frictional surface draws the front card downward and forward.

The internal operation and inter-component operation of the pick-up roller can provide important performance characteristics to the operation of the apparatus. As previously mentioned, one method according to the present invention relates to a card delivery subcomponent that comprises a preliminary card-moving element that temporarily disengages or stops its delivery action or card control action upon sensing, upon acceleration of the card by a second card moving mechanism or as a result of card contact with a second card-moving or card-delivery component or subcomponent. That is, a first card-moving component moves individual cards from a first location (e.g., the card-receiving stack) toward a second location (e.g., toward a hand-receiving compartment) and a second card-moving component receives or intercepts the individual cards. When the second card-moving component intercepts an individual card or begins to guide or move an individual card, the first card-moving component must disengage its card-moving action to prevent that card-moving action from either jamming the apparatus, causing drag and excessive wear on the card, excessively directing or controlling an individual card, or moving too many cards (e.g., more than one card) at the same time. These methods are effected by the operation of the pick-up roller 150 and its operating relationship with other card-motivating or -receiving components (such as rollers 162 and 164).

For example, a dynamic clutch, slip clutch mechanism or release gearing may be provided within the pick-up roller 150. Alternatively a sensor, gearing control, clutch control or pick-up roller motor drive control may be provided to control the rotational speed, rotational drive or torque, or frictional engagement of the pick-up roller 150. These systems operate to reduce or essentially eliminate any adverse or significant drag forces that would be maintained on an individual card (C) in contact with pick-up roller 150 at the time when other card-motivating components or subcomponents begin to engage the individual card (e.g., rollers 162 and 164). There are a number of significant and potential problems that can be engendered by multiple motivation forces on a single card and continuous motivating forces from the pick-up roller 150. If the pick-up roller stopped rotating without disengaging from the drive mechanism, the speed-up rollers 162 and 164 would need to apply a sufficient force on the card to overcome a drag caused by the stationary pick-up roller 150. The drag forces cause the cards to wear prematurely. If the pick-up roller 150 were to continuously provide torque or moving forces against surfaces of individual cards, the speed of rotation of that pick-up roller must be substantially identical to the speed of moving forces provided by any subsequent card-moving components or subcomponents. If that were not the case, stress would be placed on the card or the surface of the card to deteriorate the card, abrade the card, compress the card, damage printing or surface finishes on the cards (even to a point of providing security problems with accidental card marking), and jam the apparatus. By a timely disengaging of forces provided by the pick-up roller against a card or card surface, this type of damage is reduced or eliminated.

Additional problems from a configuration that attempts to provide continuous application of a driving force by the pick-up roller against cards is the inability of a pick-up roller to distinguish between one card and an underlying card or groups of cards. If driving forces are maintained by the pick-up roller against card surfaces, once card C, as shown in FIG. 5, passes out of control or contact with the pick-up roller 150, the next card is immediately contacted and moved, with little or no spacing between cards. In fact, after card C has immediately left contact with pick-up roller 150, because of its tendency to be positioned inwardly along card C and away from the edge of card C when firmly within the stack of cards (not shown) advanced by block 68, the pick-up roller 150 immediately is pressed into engagement with the next card (not shown) underlying card C. This next underlying card may, therefore, be advanced along the same path as card C, even while card C still overlays the underlying card. This would, therefore, offer the distinct likelihood of at least two cards being transferred into the second card-moving components (e.g., rollers 162 and 164) at the same time, those two cards being card C and the next underlying card. These cards would also be offset and not identically positioned. This could easily lead to multiple cards being inserted into individual compartments or cards jamming the apparatus as the elevator or carousel moves to another position to accept different cards. The sensors can also read multiple cards being fed as a single card, causing an error message, and leading to misdeals. The apparatus preferably counts the cards being arranged and verifies that the correct number of cards are present in the deck. When multiple cards pass the sensors at the same time, the machine will produce an error message indicating that one or more cards is missing. Misdeals slow the play of the game and reduce casino revenue.

The practice of the present invention of disengaging the moving force of the pick-up roller when other individual card-moving elements are engaging individual cards can be a very important function in the performance and operation of the hand-delivering apparatus of this invention. This disengaging function may operate in a number of ways as described herein, with the main objective being the reduction or elimination of forward-moving forces or drag forces on the individual card once a second individual card-moving element, component or subcomponent has begun to engage the individual card or will immediately engage the individual card. For example, the pick-up roller may be automatically disengaged after a specific number of revolutions or distance of revolutions of the roller (sensed by the controller or computer, and identifying the assumption that such degree of movement has impliedly engaged a second card-moving system), a sensor that detects a specific position of the individual card indicating that the individual card has or is imminently about to engage a second card-moving component, a timing system that allows the pick-up roller to operate for only a defined amount of time that is assumed to move the individual card into contact with the second card-moving component, a tension-detecting system on the pick-up roller that indicates either a pressure/tension increase (e.g., from a slowed movement of the individual card because of contact with a second card-moving component) or a tension decrease (e.g., from an increased forward force or movement of the individual card as it is engaged by a more rapidly turning set of rollers 162 and 164), or any other sensed information (such as acceleration of the card) that would indicate that the individual card, especially while still engaged by the pick-up roller, has been addressed or treated or engaged or directed or moved by a second card-moving component or subcomponent.

The disengagement may be effected in a number of different ways. It is reasonably assumed that all pick-up rollers have a drive mechanism that rotates the pick-up roller, such as an axle-engaging drive or a roller-engaging drive. These drives may be belts, contact rollers, gears, friction contact drives, magnetic drives, pneumatic drives, piston drives or the like. In one example of the invention, a dynamic clutch mechanism may be used that allows the drive mechanism to disengage from the roller or allows the roller to freely rotate at the same speed as the engaging drive element, the pick-up roller 150 will rotate freely or with reduced tension against the forward movement of the individual card, and the card can be freely moved by the second card-moving component. The use of a dynamic clutch advantageously keeps the card in motion compressed against the stack of cards being distributed, providing more control and virtually eliminating the misfeeding of cards into the second card-moving components. This "positive control" enables the cards to be fed at faster speeds and with more accuracy than with other known card feed mechanisms. Clutch systems may be used to remove the engaging action of the drive mechanism against the pick-up roller 150. Gears may disengage, pneumatic or magnetic pressure/forces may be diminished, friction may be reduced or removed, or any other disengagement procedure may be used. A preferred mechanism is the use of a speed release clutch, also known in the art as a speed drop clutch, a drag clutch, a free-rolling clutch or a draft clutch. This type of clutch is used particularly in gear-driven roller systems where, upon the occurrence of increased tension (or increased resistance) against the material being driven by a roller, a clutch automatically disengages the roller drive mechanism, allowing the roller to freely revolve so that the external roller surface actually increases its speed of rotation as the article (in this case, the playing card) is sped up by the action of the second card-moving component. At the same time, the pick-up roller 150 remains in contact with the card, causing a more reliable and positive feeding action into the second card-moving components. The clutch may also be designed to release if there is increased resistance, so that the pick-up roller turns more slowly if the second card-moving element moves the individual card more slowly than does the pick-up roller.

In one example of the invention, cards are moved in response to the microprocessor calling for the next card. The rate at which each card is fed is not necessarily or usually constant. Activation of the pick-up roller 150 is, therefore, intermittent. Although it is typical to rotate the axle 152 upon which pick-up roller 150 is mounted at one angular speed, the timing of the feeding of each individual card to each compartment may vary. Since a random number generator determines the location of insertion of each card into individual compartments, the time between initiation of each rotation of the pick-up roller and the insertion of each card into a compartment may vary. It is possible to impose a uniform time interval of initiation (e.g., equal to the maximum time interval possible between inserting a card into the uppermost compartment and then the lowermost compartment) of the movement of the rotation of the pick-up roller but the shuffling time would increase. Similarly, when the compartments are in a carousel-type arrangement, the operation of pick-up roller 150 is also intermittent—that is, not operating at a constant timed interval.

Referring now to FIGS. 4 and 5, the preferred card-moving mechanism 30 also includes a pinch roller system card accelerator or speed-up system 160 located adjacent to the front of the well 60 between the well 60 and the rack assembly 28 and forwardly of the pick-up roller 150. The speed-up system 160 comprises a pair of axle-supported, closely adjacent speed-up rollers, one above the other, including a lower roller 162 and an upper roller 164. The idling upper roller 164 is urged toward the lower roller 162 by a spring assembly 166. Alternatively, it may be weighted or drawn toward the lower roller by a resilient member (not shown). The lower roller 162 is driven by a speed-up motor 167 operably linked to the lower driven roller 162 by a suitable connector 168 such as a belt or a chain. The mounting bracket 170 for the speed-up rollers also supports a rearward card in sensor 174 and a forward card out sensor 176. When the individual card C is engaged by these rollers 162 and 164 that are rotating with a linear surface speed that exceeds the linear surface speed of the pick-up roller 150, the forward tension on the pick-up roller 150 exerted by card C is one characteristic that can be sensed by the controller to release the clutch (not shown) that releases the pick-up roller 150 and allows the pick-up roller 150 to rotate freely. In the event that a dynamic clutch is utilized, the increase in speed of the motivated card caused by the surface speed of rollers 162 and 164 relative to the surface speed of the motivated card effected by the pick-up roller 150 when axle 152 is being driven causes disengagement of the clutch.

FIG. 5 is a largely representational view depicting the relationship between the card-receiving well 60 and the card-transporting mechanism 30, and also shows a card □C□ being picked up by the pick-up roller 150 moving in rotational direction 151 and being moved into the pinch roller system 160 for acceleration into a compartment 104 of the rack assembly 28.

In a preferred embodiment, the pick-up roller 150 is not continuously driven, but rather indexes in response to instructions from the microprocessor and includes a one-way clutch mechanism. After initially picking up a card and advancing it into the pinch roller system 160, the motor 154 operably coupled to the pick-up roller 150 stops driving the roller, and the roller 150 free-wheels as the card is accelerated through the pinch roller system 160. The speed-up pinch roller system 160 is preferably continuous in operation once a hand-forming cycle starts and, when a card is sensed by the adjacent card out sensor 176, the pick-up roller 150 stops and free-wheels while the card is accelerated through the pinch roller system 160. When the trailing edge of the card is sensed by the card out sensor 176, the rack assembly 28 moves to the next position for the next card and the pick-up roller 150 is reactivated.

Additional components and details of the card-transport mechanism 30 are depicted in FIG. 6, an exploded assembly view thereof. In FIG. 6, the inclined floor surface 66 of the well 60 is visible, as are the axle-mounted pick-up and pinch roller system 150, 160, respectively, and their relative positions.

Referring to FIGS. 4 and 5, the transport assembly 30 includes a pair of generally rigid stopping plates including an upper stop plate and a lower stop plate, 180, 182, respectively.

The plates 180, 182 are positioned between the rack assembly 28 and the speed-up system 160 immediately forward of and above and below the pinch rollers 162, 164. The stop plates 180, 182 stop the cards from rebounding or bouncing rearwardly, back toward the pinch rollers 162, 164, as they are driven against and contact a gate 144 and/or a stop 142 (FIG. 3) at the front of the rack assembly 28.

Processing/Control Unit

Figure 16:
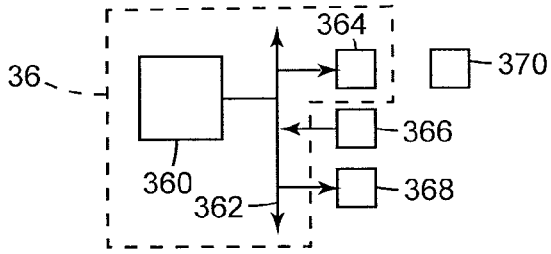
FIG. 16 is a schematic diagram of an electrical control system for one embodiment of the present invention.

FIG. 16 is a block diagram depicting an electrical control system that may be used in one embodiment of the present invention. The electrial control system includes a controller 360, a bus 362, and a motor controller 364. Also represented in FIG. 16 are inputs 366, outputs 368, and a motor system 370. The controller 360 sends signals to both the motor controller 364 and the outputs 368 while monitoring the inputs 366. The motor controller 364 interprets signals received over the bus 362 from the controller 360. The motor system 370 is driven by the motor controller 364 in response to the commands from the controller 360. The controller 360 controls the state of the outputs 368 and the state of the motor controller 364 by sending appropriate signals over the bus 362.

In a preferred embodiment of the present invention, the motor system 370 comprises motors that are used for operating components of the card-handling apparatus 20. Motors operate the pick-up roller, the pinch and speed-up rollers, the pusher and the elevator. The gate and stop may be operated by a motor, as well. In such an embodiment, the motor controller 364 would normally comprise one or two controllers and driver devices for each of the motors used. However, other configurations are possible.

The outputs 368 include, for example, alarm, start, and reset indicators and inputs and may also include signals that can be used to drive a display device (e.g., an LED display, not shown). Such a display device can be used to implement a timer, a card counter, or a cycle counter. Generally, an appropriate display device can be configured and used to display any information worthy of display. The inputs 366 are information from the limit switches and sensors described above. The controller 360 receives the inputs 366 over the bus 362.

Figure 17:
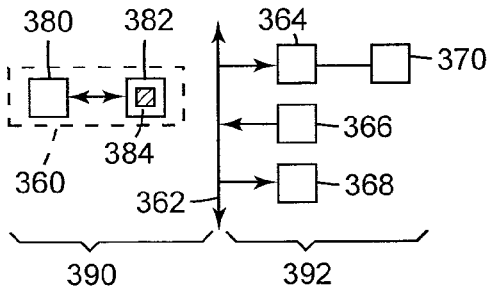
FIG. 17 is a schematic diagram of the electrical control system.

Although the controller 360 can be any digital controller or microprocessor-based system, in a preferred embodiment, the controller 360 comprises a processing unit 380 and a peripheral device 382 as shown in FIG. 17. The processing unit 380 in a preferred embodiment may be an 8-bit single-chip microcomputer such as an 80C52 manufactured by the Intel Corporation of Santa Clara, Calif. The peripheral device 382 may be a field-programmable microcontroller peripheral device that includes programmable logic devices, EPROMs, and input-output ports. As shown in FIG. 17, peripheral device 382 serves as an interface between the processing unit 380 and the bus 362.

The series of instructions are stored in the controller 360 as shown in FIG. 17 as program logic 384. In a preferred embodiment, the program logic 384 is RAM or ROM hardware in the peripheral device 382. (Since the processing unit 380 may have some memory capacity, it is possible that some or all of the instructions may be stored in the processing unit 380.) As one skilled in the art will recognize, various implementations of the program logic 384 are possible. The program logic 384 could be either hardware, software, or a combination of both. Hardware implementations might involve hardwired code or instructions stored in a ROM or RAM device. Software implementations would involve instructions stored on a magnetic, optical, or other media that can be accessed by the processing unit 380. Under certain conditions, it is possible that a significant amount of electrostatic charge may build up in the card handler 20. Significant electrostatic discharge could affect the operation of the handler 20. It is preferable to isolate some of the circuitry of the control system from the rest of the machine. In a preferred embodiment of the present invention, a number of optically coupled isolators are used to act as a barrier to electrostatic discharge.

Figure 18:
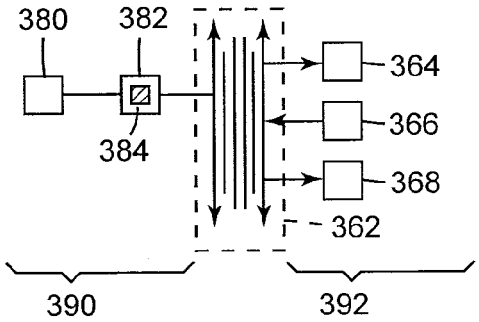
FIG. 18 is a schematic diagram of an electrical control system with an optically isolated bus.
Figure 19:
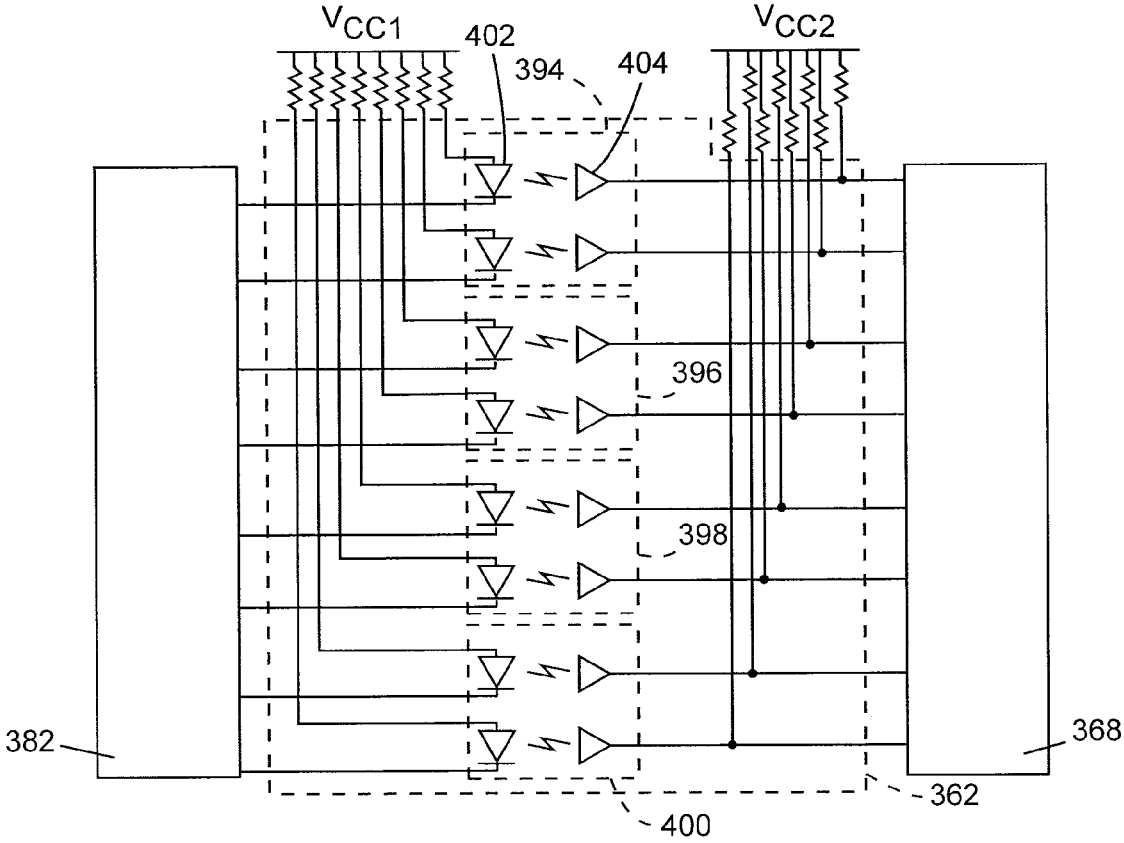
FIG. 19 is a detailed schematic diagram of a portion of the control system illustrated in FIG. 18.

As shown in FIG. 18, a first group of circuitry 390 can be electrically isolated from a second group of circuitry 392 by using optically coupled logic gates that have light-emitting diodes to optically (rather than electrically) transmit a digital signal, and photo detectors to receive the optically transmitted data. An illustration of electrical isolation through the use of optically coupled logic gates is shown in FIG. 19, which shows a portion of FIG. 18 in greater detail. Four Hewlett-Packard HCPL-2630 optocouplers (labeled 394, 396, 398 and 400) are used to provide an 8-bit isolated data path to the output devices 368. Each bit of data is represented by both an LED 402 and a photo detector 404. The LEDs emit light when energized and the photo detectors detect the presence or absence of the light. Data may be thus transmitted without an electrical connection.

Second Card-Moving Mechanism

Figure 8:
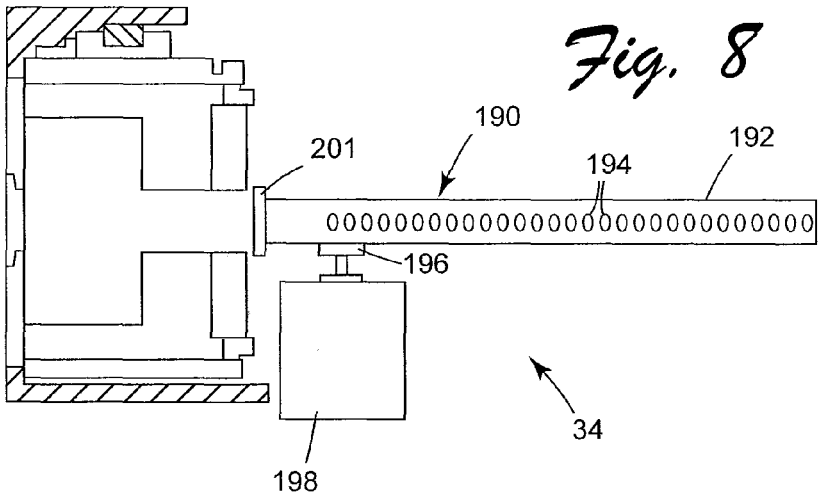
FIG. 8 is a top plan view of the pusher assembly of the present invention.

Referring to FIGS. 4 and 8, the apparatus 20 includes a second card-moving mechanism 34 comprising, by way of example only, a reciprocating card compartment unloading pusher 190. The pusher 190 includes a substantially rigid pusher arm 192 in the form of a rack having a plurality of linearly arranged apertures 194 along its length. The arm 192 operably engages the teeth of a pinion gear 196 driven by an unloading motor 198, which is, in turn, controlled by the microprocessor 360 (see FIGS. 16 and 17). At its leading or card contacting end, the pusher arm 192 includes a blunt, enlarged card-contacting end portion 201. The end portion 201 is greater in height than the space between the shelf members 104 forming the compartments 106 to make sure that all the cards (i.e., the hand) contained in a selected compartment are contacted and pushed out as it is operated, even when the cards are bowed or warped. The second card-moving mechanism 34 is operated intermittently (upon demand or automatically) to empty full compartments 106 at or near the end of a cycle.

Second Card/Hand Receiver

When actuated, the second card-moving mechanism 190 empties a compartment 106, 120 by pushing the group of cards therein into a card receiving platform 36. The card-receiving platform 36 is shown in FIGS. 1, 4, 14 and 16, among others. In this way, a complete hand is pushed out, with usually one hand at a time fed to the card-receiving platform 36 (or more properly, card-retrieving platform). The hands are then, usually, manually retrieved by a dealer and placed at player positions. In one example of the invention, the card-receiving platform 36 has a card present sensor. As a hand of cards is removed, the sensor senses the absence of cards and sends a signal to the microprocessor. The microprocessor, in turn, instructs the device to deliver another hand of cards.

Figure 15:
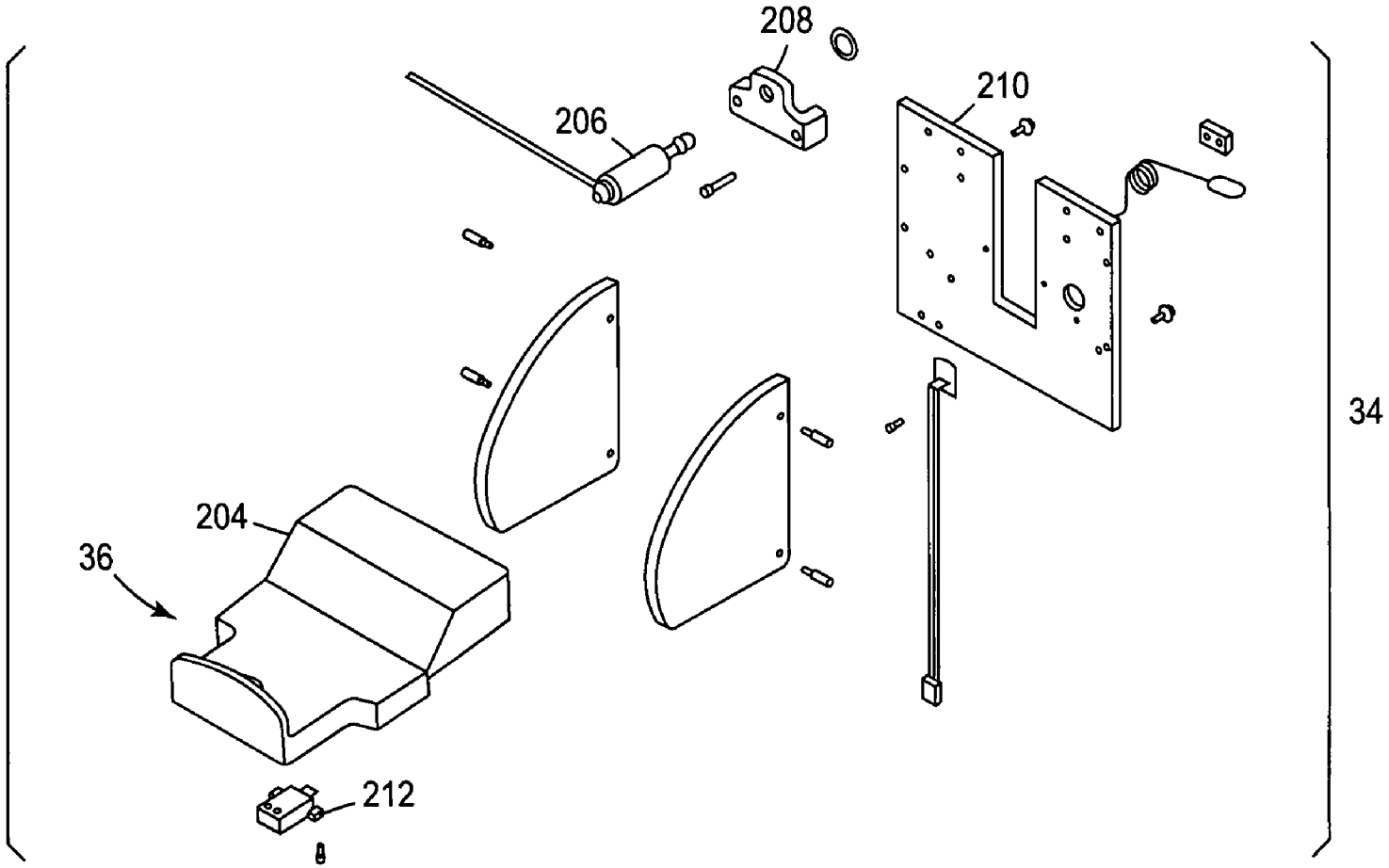
FIG. 15 is an exploded view of the hand-receiving assembly of the apparatus of the present invention.

Referring to FIG. 15, the second card- or hand-receiving platform 36 includes a shoe plate 204 and a solenoid assembly 206, including a solenoid plate 208, carried by a rear plate 210, which is also the front plate of the rack assembly 28. In an alternate embodiment, a motor drives the gate. The shoe plate 204 also carries an optical sensing switch 212 for sensing the presence or absence of a hand of cards and for triggering the microprocessor to drop the gate 144 (FIG. 3) and actuate the pusher 190 (FIG. 4) of the second transport assembly 34 to unload another hand of cards from a compartment 106, 120 (not shown) when the hand receiver 36 is empty. In a first preferred embodiment, all hands are unloaded sequentially. In another embodiment, the dealer delivers cards to each player, and the dealer hand is delivered last. Then he or she presses a button that instructs any remaining hands and the discard pile to unload. According to a third preferred embodiment, the microprocessor is programmed to randomly select and unload all player hands, then the dealer hand, and last the discard pile or piles.

Figure 14:
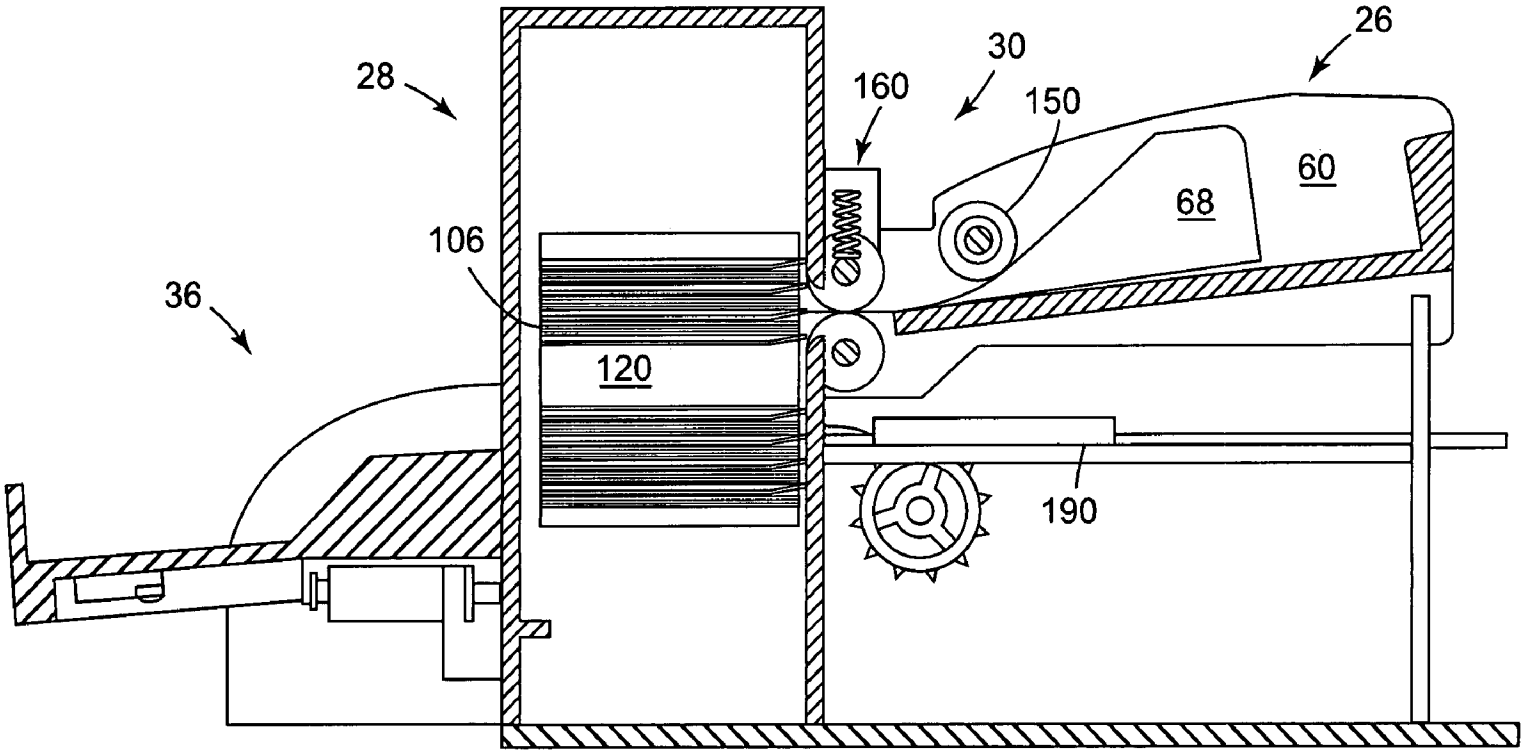
FIG. 14 is a simplified side elevational view, largely representational, of the first card handler of the present invention.

FIG. 14 is a largely representational view depicting the apparatus 20 and the relationship of its components including the card receiver 26 for receiving a group of cards for being formed into hands, including the well 60 and block 68, the rack assembly 28 and its single stack of card-receiving compartments 106, 120, the card-moving or transporting-mechanism 30 between and linking the card receiver 26 and the rack assembly 28, the second card mover 190 for emptying the compartments 106, 120, and the second receiver 36 for receiving hands of cards.

Alternative Embodiments

Figure 20:
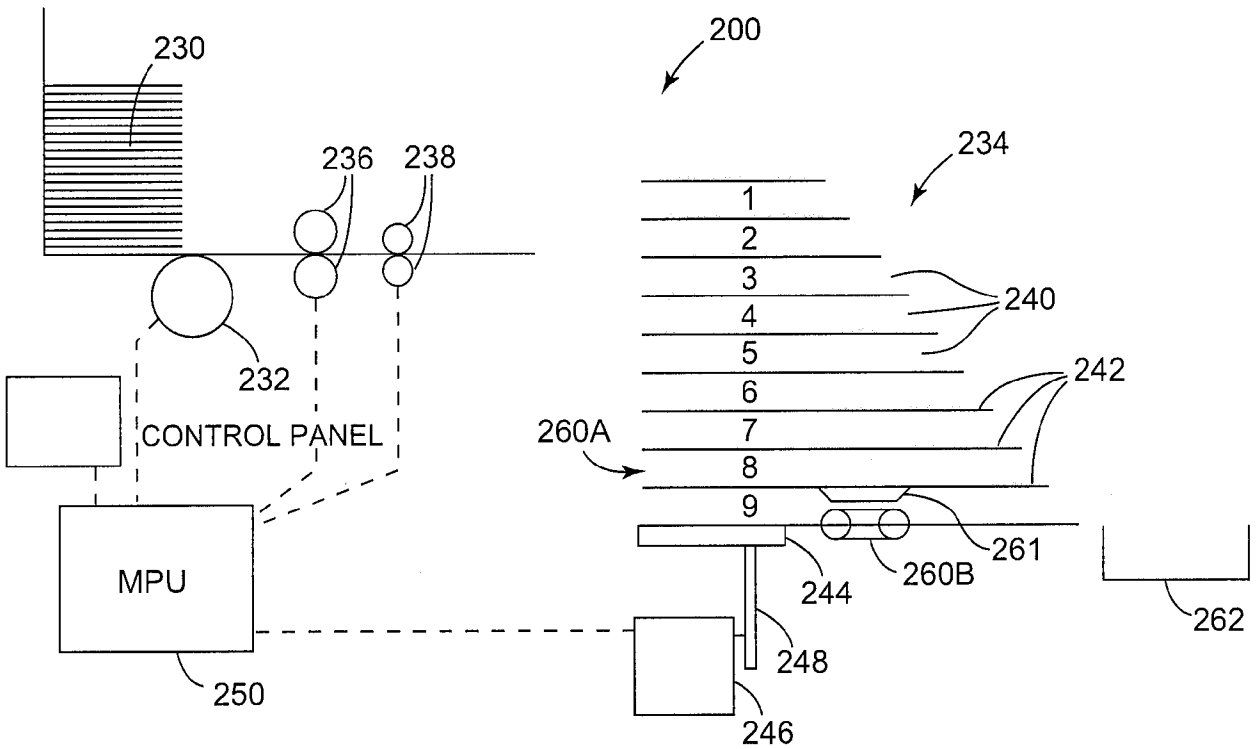
FIG. 20 schematically depicts an alternative embodiment of the apparatus of the present invention.

FIG. 20 represents an alternative embodiment of the present invention wherein the card handler 200 includes an initial staging area 230 for receiving a vertically stacked deck or group of unshuffled cards. Preferably, beneath the stack is a card extractor 232 that picks up a single card and moves it toward a grouping device 234. The picked up card moves through a card separator 236, which is provided in case more than one card is picked up, and then through a card accelerator 238. The grouping device 234 includes a plurality of compartments 240 defined, in part, by a plurality of generally horizontally disposed, parallel shelf members 242. In one embodiment, there are two more compartments than player positions at the table at which the device is being used. In one preferred embodiment, the grouping device 234 includes nine compartments (labeled 1-9), seven of which correspond to the player positions, one that corresponds to the dealer's position and the last for discards. The grouping device 234 is supported by a generally vertically movable elevator 244, the height of which is controlled by a stepper motor 246, linked by means of a belt drive 248 to the elevator 244. A microprocessor 250 randomly selects the location of the stepper motor 246 and instructs the stepper motor 246 to move the elevator 244 to that position. The microprocessor 250 is programmed to deliver a predetermined number of cards to each compartment 240. After the predetermined number of cards is delivered to a compartment 240, no additional cards will be delivered to that compartment.

Each time a group of unshuffled cards are handled by this embodiment of the present invention, the order in which the cards are delivered to the compartments 240 is different due to the use of a random number generator to determine which compartment receives each card in the group. Making hands of cards in this particular fashion serves to randomize the cards to an extent sufficient to eliminate the need to shuffle the entire deck prior to forming hands.

A feature of the embodiment of the present invention depicted in FIG. 20 is a card pusher or rake 260A. The rake 260A may be either an arm with a head that pushes horizontally from the trailing edge of a card or group of cards, or a roller and belt arrangement 260B which propels a card or group of cards by providing frictional contact between one or more rollers and a lower surface of a card or the bottommost card. In one other example of the invention, a spring device 261 holds the cards against the rake 260A causing one card at a time to be removed into tray 262. The purpose of the rake 260A is to move the cards toward an open end of the elevator 244. In this embodiment of the invention, the compartments 240 are staggered so that if the card rake 260A only pushes the dealt cards a portion of the way out, the dealer can still lift out each hand of cards and deliver the hand to a player. The rake 260A can also be set to push a hand of cards completely out of a compartment, whereby the cards fall onto a platform 262. The hand delivered to platform 262 may then be removed and handed to the player. A sensor may be provided adjacent to the platform 262, whereby an empty platform is sensed so that the rake 260A pushes or propels another hand of cards onto the platform 262.

In another embodiment, the microprocessor 250 is programmed so that the card rake 260A moves the cards to a point accessible to the dealer and then, upon optional activation of a dealer control input, pushes the cards out of the compartment 240 onto the receiver 262.

In a preferred embodiment of the device depicted in FIG. 20, although the microprocessor 250 can be programmed to deliver a different number of cards to the dealer compartment than to the player compartments, it is contemplated that the microprocessor 250 will cause the apparatus 200 to deliver the same number of cards to each compartment. The dealer, however, may discard cards until he or she arrives at the desired number of dealer cards for the particular game being played. For example, for the poker game known as the LET IT RIDE® stud poker game, the players and dealer initially receive a three-card hand. The dealer then discards or burns one of his cards and plays with the remaining two cards.

With continued reference to FIG. 20, nine card compartments or slots are depicted. The card extractor/separator combination delivers a selected number of player cards into each of the compartments labeled 1-7. Preferably, the same number of dealer's cards may be delivered into compartment 8. Alternatively, the microprocessor 250 can be programmed so that slot 8 will receive more than or fewer than the same number of cards as the players' compartments 1-7. In the embodiment depicted in FIG. 20, card-receiving compartment 9, which may or may not be larger than the others, receives all extra cards from a deck. Preferably, the MPU instructs the device card handler to form only the maximum number of player hands plus a dealer hand. The number of cards delivered to each position may depend upon the game and the number of cards required.

Operation/Use

Figure 21A:
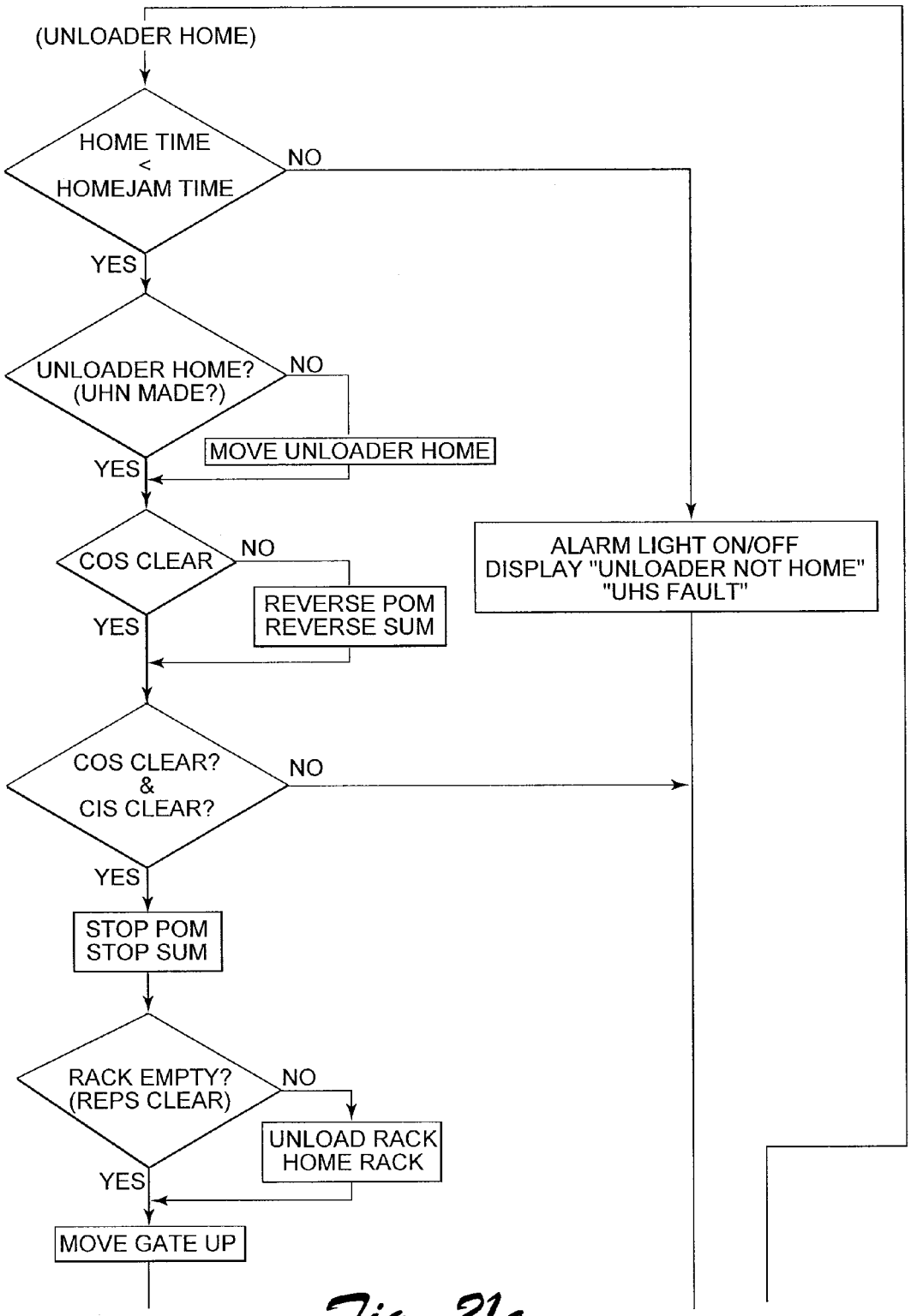
FIG. 21 is a flow diagram, comprising two parts, shown in FIGS. 21*a* and 21*b*, depicting a homing sequence.
Figure 21B:
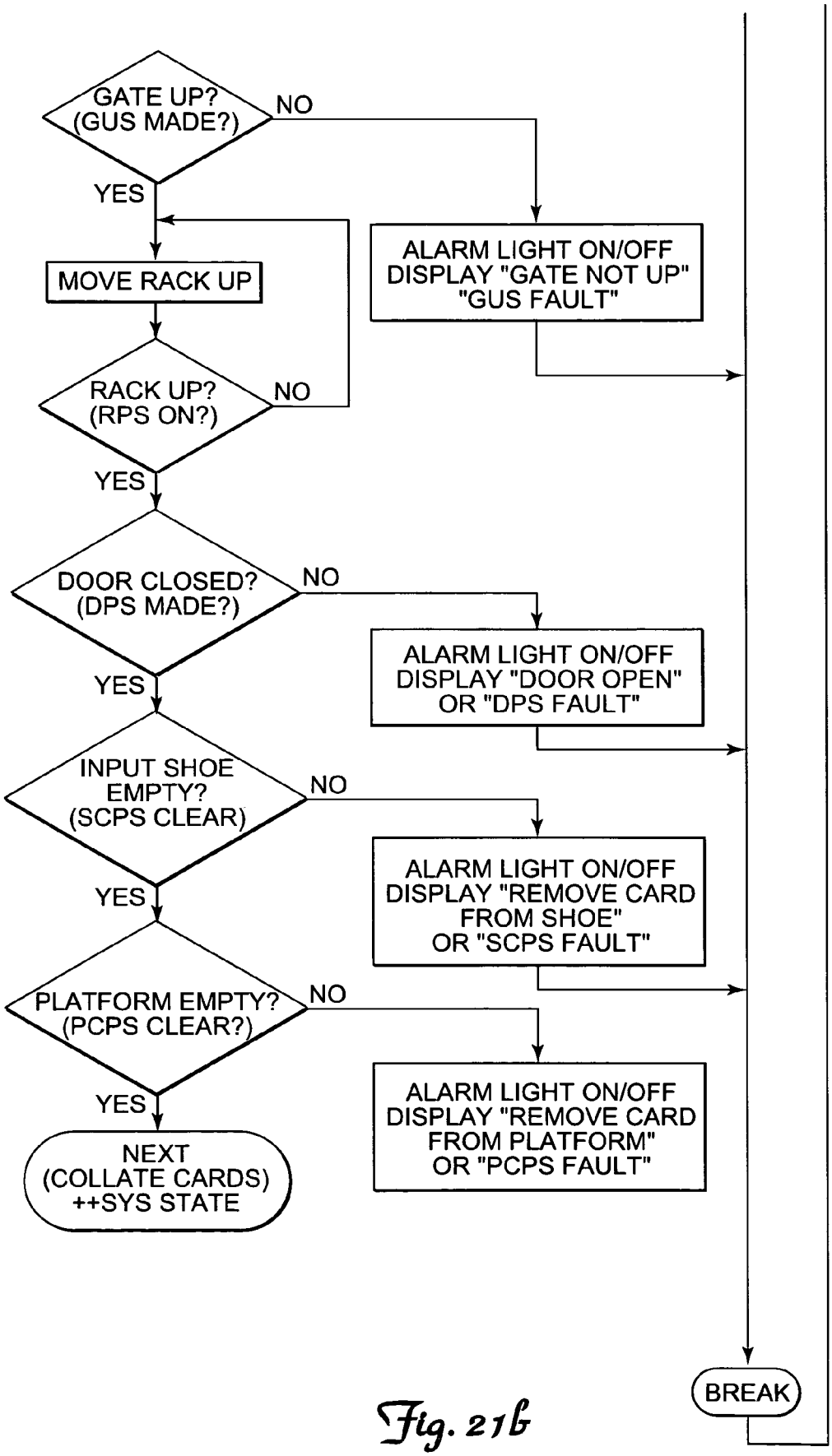
Figure 22A:
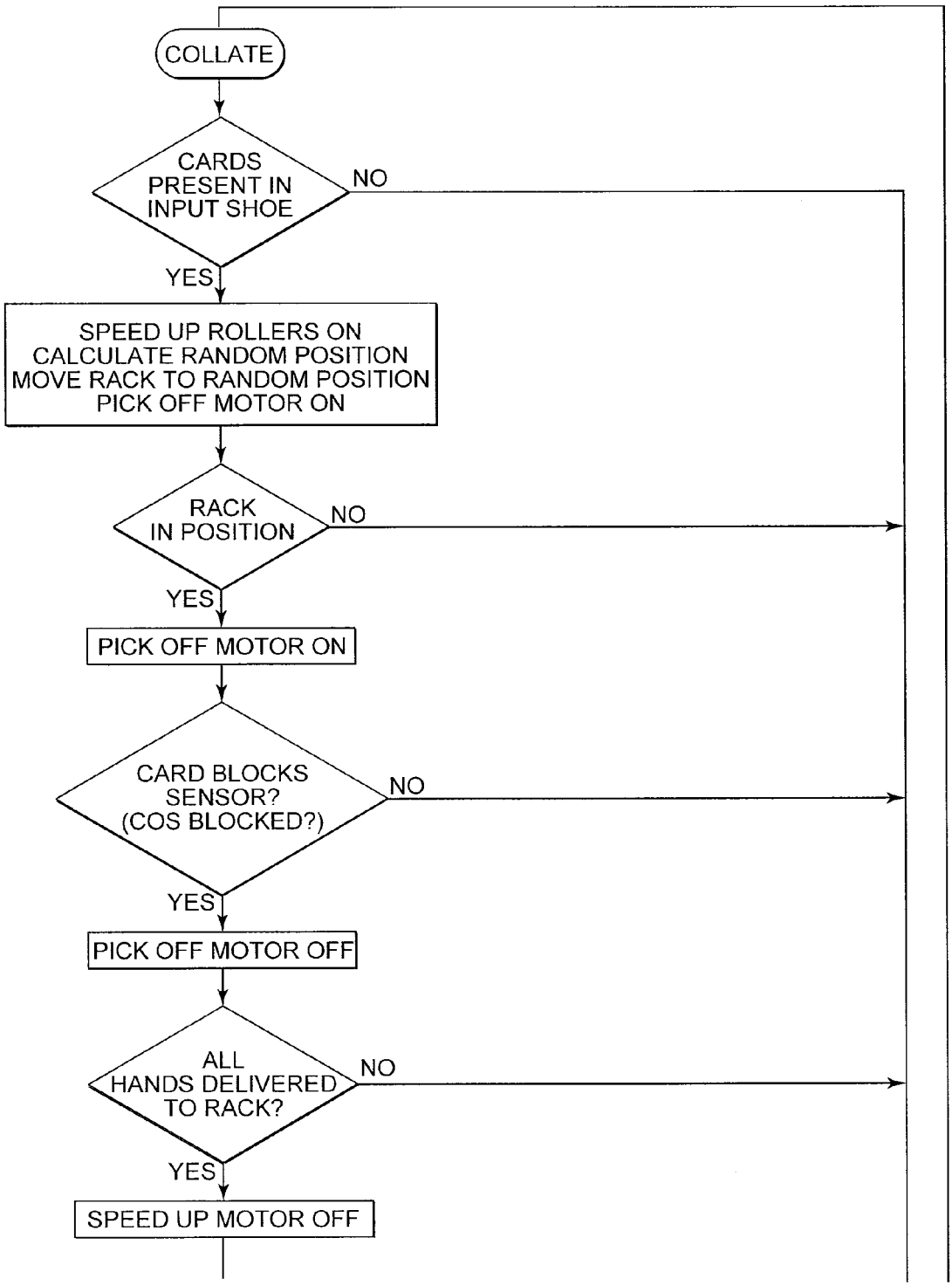
FIG. 22 is a flow diagram, comprising three parts, shown in FIGS. 22*a*, 22*b* and 22*c*, depicting a sequence of operation of the present invention.
Figure 22C:
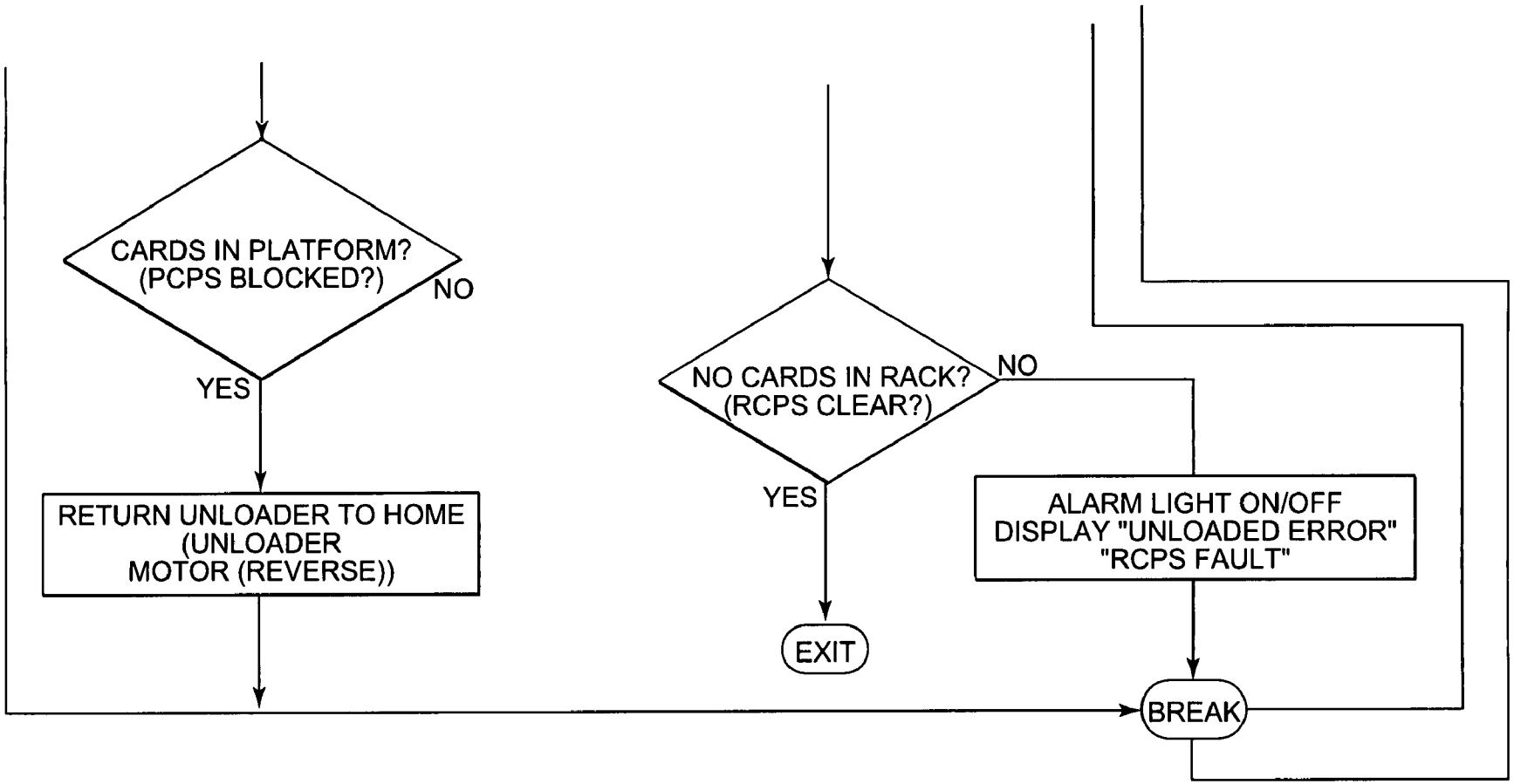

With reference to FIGS. 21 and 22, and Appendix C, which depict an operational program flow of the method and apparatus of the present invention, in use, cards are loaded into the well 60 by sliding or moving the block 68 generally rearwardly. The group of cards to be formed into hands is placed into the well 60 generally sideways, with the plane of the cards generally vertical, on one of the long side edges of the cards. The block 68 is released or replaced to urge the cards into an angular position generally corresponding to the angle of the angled card-contacting face of the block 68, and into contact with the pick-up roller 150.

According to the present invention, the group of cards to be formed into hands is one or more decks of standard playing cards. Depending upon the game, the group of cards can contain one or more wild cards, can be a standard deck with one or more cards removed, can comprise a special deck such as a canasta or SPANISH 21® deck, for example, can include more than one deck, or can be a partial deck not previously recognized by those skilled in the art as a special deck. The present invention contemplates utilizing any group of cards suitable for playing a card game. For example, one use of the device of the present invention is to form hands for a card game that requires the use of a standard deck of cards with all cards having a face value of 2-5 removed.

The card-handling device of the present invention is well-suited for card games that deliver a fixed number of cards to each player. For example, the LET IT RIDE® stud poker game requires that the dealer deliver three cards to each player, and three cards to the dealer. For this application, the microprocessor is set so that only three-card hands are formed.

When the power is turned on, the apparatus 20 homes (see FIG. 21*a* and 21*b* and Appendix B) and the start input is actuated and the process cycle begins. As the cards are picked up, i.e., after the separation of a card from the remainder of the group of cards in the well 60 is started, a card is accelerated by the speed-up system 160 and spit or moved past the plates 180, 182 into a selected compartment 106, 120. Substantially simultaneously, movement of subsequent cards is underway. The rack assembly 28 position relative to the position of the card-transporting mechanism 30 is monitored, selected and timed by the microprocessor whereby a selected number of cards is delivered randomly to selected compartments until the selected number of compartments 106 each contain a randomized hand of a selected number of cards. The remainder of the cards are delivered to the discard compartment 120, either before, during or after delivering the card-forming hands. Because the order in which the cards are delivered is completely random, the device may or may not deliver all cards in the initial group of cards to all compartments before the first player hand is pushed out of its compartment.

Before or when all the cards have been delivered to the compartments, upon demand or automatically, the pusher 190 unloads one randomly selected hand at a time from a compartment 106 into the second card-receiving platform 36. The pusher 190 may be triggered by the dealer or by the hand present sensor 212 associated with the second receiver 36. When the last hand is picked up and delivered to players and/or dealer, the larger discard compartment 120 automatically unloads. It should be appreciated that each cycle or operational sequence of the apparatus 20 goes through an entire group or deck of cards placed in the well 60 each time, even if only two players, i.e., two hands, are used.

Figure 23:
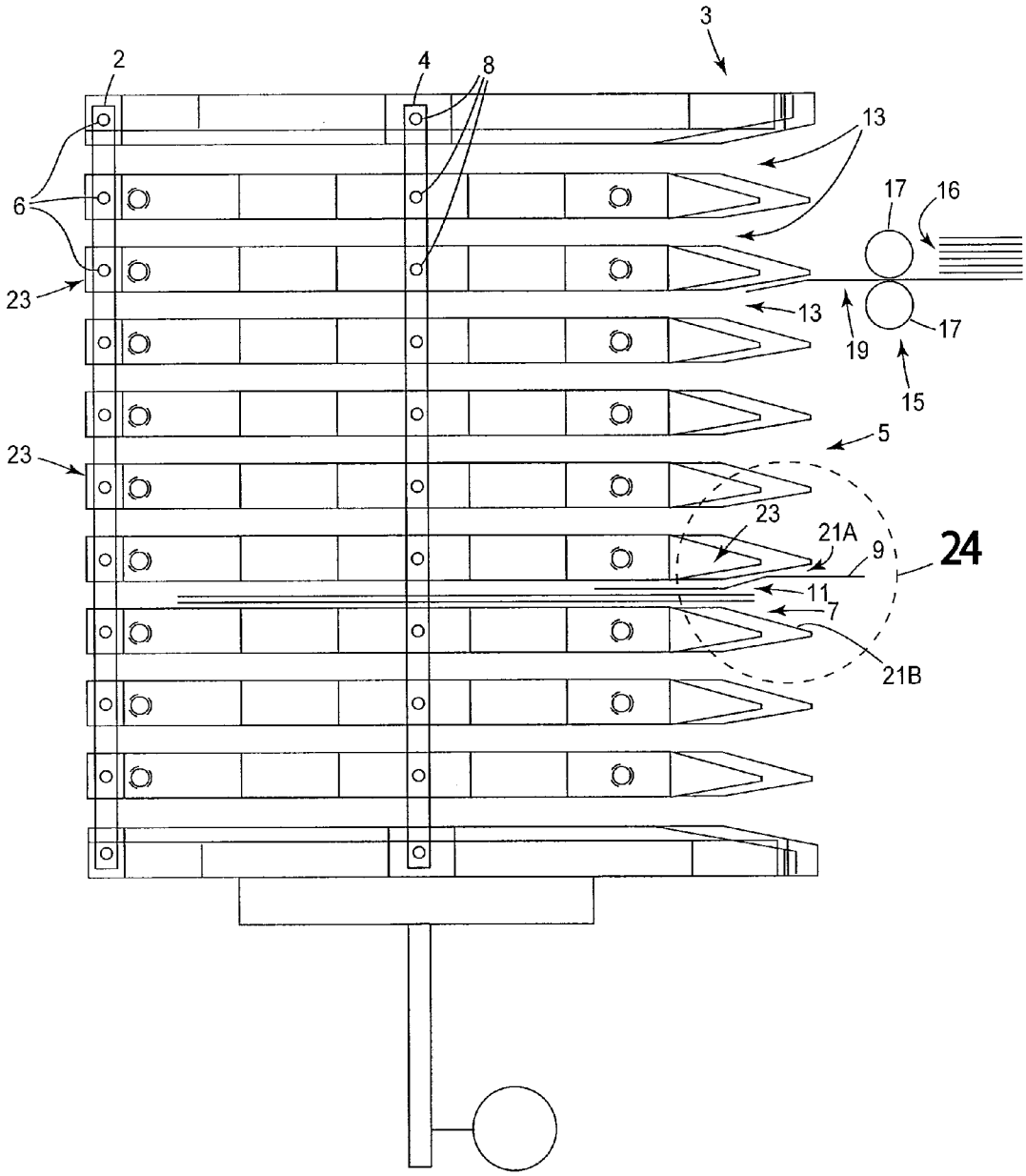
FIG. 23 shows a side cutaway view of a rack comprising a series of compartments with separators having two acute surfaces on an edge of the separators facing a source of cards to be inserted into the compartments.

FIG. 23 also shows a clearly optional method of controlling the entry of cards into the rack 3 of card-receiving compartments 13. A card delivery system 15 is shown wherein two nip rollers 17 accept individual cards 19 from a stack of cards 16 and direct the individual cards 19 into a single card-receiving compartment 13. As shown in a lower right-hand portion of FIG. 23, as shown in a dashed line circle, a single card 9 is directed into one of the card-receiving compartments 13 so that the individual card 9 strikes one of the acute angle surfaces 21A, 21B of the separator 23. The single card 9 is shown with a double bend 11 caused by the forces from the single card 9 striking the acute angle surface 21A and then the upper surface of the top 11 of cards 7 already positioned within the card-receiving compartment 13. The card delivery system 15 and/or the rack 3 may move vertically (and/or angularly, as explained later) to position individual cards (e.g., card 9) at a desired elevation and/or angle in front of individual card-receiving compartments 13. The specific distance or angle that the card delivery system 15 and/or rack 3 moves are controlled (when acute angle surfaces 21A, 21B of the separators 23 are available) to position the individual card 9 so that it deflects against a specific acute angle surface 21A, 21B.

An alternative method of assisting in the guidance of an individual card 9 against an acute angle surface 21A, 21B is the system shown that is enabled by bars 2 and 4. The bars 2 and 4 operate so that as they move relative to each other, the separators 23 may swivel around pins 6 and 8 causing the separators 23 to shift, changing the effective angle of the deflecting acute angle surfaces 21A, 21B with respect to individual cards 9. This is not as preferred as the mechanism by which the rack 3 and/or the card delivery system 15 move relatively vertically to each other.

Figure 24:
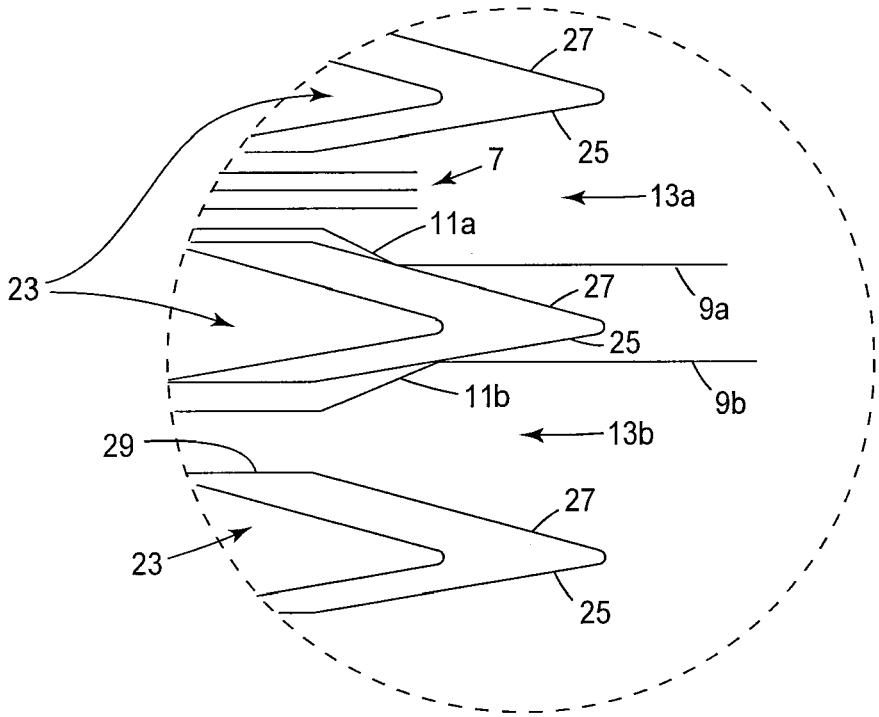
FIG. 24 shows an exploded image of three adjacent acute surface edges of separators in the rack of separators.

FIG. 24 shows a blown-up view of a set of three separators 23. These separators are shown with acute angles (less than 90° with respect to horizontal or the plane of the separator 23 top surfaces 29) on both sides of the separators 23 (with only one top surface 29 shown in FIG. 24 for clarity). An upward deflecting surface 27 and downward deflecting surface 25 is shown on each separator 23. In one section of FIG. 24, a single card 9*a* is shown impacting an upward deflecting surface 27, deflecting (and bending) individual card 9*a* in a two-way bend 11*a*, the second section of the bend caused by the impact/weight of the cards 7 already within a compartment 13*a*. In a separate area of FIG. 24, a second individual card 9*b* is shown in compartment 13*b*, striking downward deflecting acute angle surface 25, with a double bend l1*b* caused by deflection off the surface 25 and then deflection off the approximately horizontal support surface 29 (or if cards are present, the upper surface of the top card) of the separator 23. The surface 29 does not have to be horizontal, but is shown in this manner for convenience. The card delivery system (not shown) moves relative to the separators 23 (by moving the card delivery system and/or the rack (not shown in its entirety) to position individual cards (e.g., cards 9*a* and 9*b*) with respect to the appropriate surfaces (e.g., surfaces 25 and 27).

The capability of addressing or positioning cards into compartments at either the top or bottom of the compartment (and consequently at the top or bottom of other cards within the compartment) enables an effective doubling of potential positions where each card may be inserted into compartments. This offers the designer of the device options on providing available alternative insert positions without adding additional card-receiving compartments or additional height to the stack. More options available for placement of cards in the compartments further provides randomness to the system without increasing the overall size of the device or increasing the number of compartments.

In this embodiment of the invention, the original rack has been replaced with rack 3 consisting of ten equally sized compartments. Cards are delivered in a random fashion to each rack. If the random number generator selects a compartment that is full, another rack is randomly selected.

In this embodiment, each stack of cards is randomly removed and stacked in platform 36, forming a randomly arranged deck of cards. Although ten compartments is a preferred number of compartments for shuffling a fifty-two card deck, other numbers of compartments can be used to accomplish random or near random shuffling. If more than one deck is shuffled at a time, more compartments could be added, if needed.

Although a description of preferred embodiments has been presented, various changes, including those mentioned above, could be made without deviating from the spirit of the present invention. It is desired, therefore, that reference be made to the appended claims rather than to the foregoing description to indicate the scope of the invention.

Appendix A

Switches and Sensors (Inputs)

| Item | Name | Description | |
|---|---|---|---|
| 212 | SCPS | Shoe Card Present Sensor | Omron * EE-SPY 302 |
| 116 | RCPS | Rack Card Present Sensor | Optek * OP598A OP506A |
| | RHS | Rack Home Switch | Microswitch * SS14A |
| | RPS | Rack Position Sensor | Omron * EE-SPZ401Y.01 |
| | UHS | Unloader Home Switch | Microswitch * SS14A |
| | DPS | Door Present Switch | Microswitch * SS14A |
| | PCPS | Platform Card Present Sensor | Omron * EE-SPY401 |
| 170 | CIS | Card In Sensor | Optek * OP506A |
| 176 | COS | Card Out Sensor | Optek * OP598A |
| | GUS | Gate Up Switch | Microswitch * SS14A |
| 44 | GDS | Gate Up Switch | Microswitch SS14-A |
| | SS | Start Switch | EAO * 84-8512.5640 84-1101.0 84-7111.500 |

Motors, Solenoid and Switches (Outputs)

| Item | Name | Description | |
|---|---|---|---|
| 154 | POM | Pick-off Motor | Superior * M041-47103 |
| 166 | SUM | Speed-up Motor | Superior * M041-47103 |
| 80 | RM | Rack Motor | Oriental * C7009-9012K |
| 198 | UM | Unloader Motor | Superior * M041-47103 |
| | FM | Fan Motor | Mechatronics * F6025L24B |
| 143 | GS | Gate Solenoid | Shindengen * F10308H w/return spring |
| | GM | Gate Motor | NMB 14PM-MZ-02 |
| | SSV | Scroll Switch—Vertical | EAO * 18-187.035 18-982.8 18-920.1 |
| | SSH | Scroll Switch—Horizontal | EAO * 18-187.035 18-982.8 18-920.1 |
| | AL | Alarm Light | Dialight * 557-1505-203 |

Display Noritake * CU20025ECPB-UIJ
Power Supply Shindengen * ZB241R8
Linear Guide THK * RSR12ZMUU + 145 M
Comm. Port Digi * HR021-ND
Power Switch Digi * SW 323-ND
Power Entry Bergquist * LT-101-3P Appendix B Homing/Power-up

| | | |
|---|---|---|
| i. | Unloader Home<br>Return unloader to home position. If it times out (jams), turn the alarm light on/off. Display "UNLOADER NOT HOME". "UHS FAULT". | UHS Made |
| ii. | Door Present<br>Check door present switch (DPS). If it's not made, display "Door Open", "DPS Fault" and turn the alarm light on/off. | DPS Made |
| iii. | Card Out Sensor (COS) Clear<br>If card out sensor is blocked: A. Check if Rack Card Present Sensor (RCPS) is blocked. If it is, drive card back (reverse both Pick-off Motor (POM) and Speed-up Motor (SUM)) until COS is clear. Keep the card in the pinch. Align rack and load card into one of the shelves. Then go through the rack empty sequence (3 below). B. If Rack Card Present Sensor (RCPS) is clear, drive card back towards the input shoe. Turn both the Speed Up Motor (SUM) and the Pick Off Motor on (reverse) until Card Out Sensor is clear plus time delay to drive the card out of the pinch. | COS Made |
| iv. | Gate Up<br>Move rack up until the rack position sensor sees the top rack (RPS on). Gate up switch should be made (GUS). If not, display "GATE NOT UP", "GUS FAULT" and turn the alarm light on/off. | GUS Made |
| v. | Rack Empty and Home<br>Check Rack Card Present Sensor (RCPS). If blocked, see emptying the racks. Return rack home when done.<br>INTERLOCK: Do not move rack if card out sensor is blocked (see 2 to clear) or when door is not present.<br>Emptying the racks: Go through the card unload sequence. Move rack down to home position. Energize solenoid. Move rack through the unload positions and unload all the cards. | RCPS Made<br>RHS Made |
| vi. | Input Shoe Empty<br>If Shoe/Card Present Sensor (SCPS) is blocked, display "remove card from shoe" or "SCPS fault" and turn the alarm light on/off. | SCPS Clear |
| vii. | Platform Empty<br>If Platform Card Present Sensor (PCPS) is blocked, display "remove card from platform" or "PCPS Fault" and turn alarm light on/off. | PCPS Clear |
| viii. | Card in Sensor (CIS) Clear.<br>If Card In Sensor (CIS) is blocked, display "remove card from shoe" or "CIS fault" and turn the alarm light on/off. | CIS Made |

Appendix B (Continued)

| Start Position | |
|---|---|
| Unloader Home | UHS Made |
| Rack Home | RHS Made |
| Rack Empty | RCPS Made |
| Door In Place | DPS Made |
| Card In Sensor Clear | CIS Made |
| Card Out Sensor Clear | COS Made |
| Gate Up | GUS Made |
| Platform Empty | PCPS Clear |
| Input Shoe Empty | SCPS Clear |
| Start Button Light On | |

Appendix C

Recovery Routine

Problem: Card Jam—COS blocked too long.
Recovery: 1. Stop rack movement.

2. Reverse both pick-off and speed-up motors until "COS" is unblocked. Stop motors.
3. If "COS" is unblocked, move rack home and back to the rack where the cards should be inserted.
4. Try again with a lower insertion point (higher rack) and slower insertion speed. If card goes in, continue insertion. If card jams, repeat with the preset positions, auto adjust to the new position. If jams become too frequent, display "check cards," replace cards. If it does not, repeat 1 and 2.
5. If "COS" is unblocked, move rack up to the top position and display "Card Jam" and turn alarm light on/off.
6. If "COS" is not unblocked after 2 or 4, display "card jam" and turn . . . (do not move rack to up position).

Problem: Unloader jams on the way out.
Recovery: Move unloader back home. Reposition rack with a small offset up or down and try again, lower speed if necessary.

If unloader jams, keep repeating at the preset location, set a new value based on the offset that works (auto adjust).

What is claimed is:

1. A mechanism for feeding cards individually in a card-handling apparatus, comprising:

a surface for supporting a stack of cards;

a feed roller with a frictional outer surface, mounted to a rotational shaft and positioned to feed cards individually from the stack into a pair of speed-up rollers;

a drive mechanism that rotates the feed roller;

a clutch mounted to the shaft for disengaging the feed roller from the drive mechanism as an individual card contacts a pair of speed-up rollers; and a pair of speed-up rollers for advancing cards individually, wherein the feed roller is disengageable from the drive mechanism.

2. The mechanism of claim 1, wherein the surface for supporting the stack of cards is a declining surface, and further comprising a slidable wedge member for sliding engagement with the declining surface and for retaining the stack against the feed roller.

3. The mechanism of claim 1, wherein the clutch is a dynamic clutch mechanism.

4. The mechanism of claim 1, wherein one of the speed-up rollers is driven by a drive mechanism.

5. The mechanism of claim 1, wherein one of the speed-up rollers is an idler roller.

6. The mechanism of claim 1, wherein at least one of the rollers mounted to a shaft is driven by a motor that can be disengaged from the roller by automatic operation of the mechanism.

7. A method of feeding cards in a card-handling apparatus, comprising:

providing a feed roller mounted for rotation about a shaft, a drive mechanism for rotating the shaft and clutch capable of disengaging the feed roller from the drive mechanism when a speed of the card accelerates and exceeds a speed of movement caused by the feed roller; and a pair of speed-up rollers;

feeding a card from a stack with the feed roller until a leading edge of the card contacts the speed-up rollers; and when the speed of the card accelerates and exceeds the speed at which the card is fed by the feed roller, the clutch disengages from the feed roller.

8. The method of claim 7, wherein after disengagement of the feed roller, the card initially remains in contact with the feed roller when a leading edge of the card comes into contact with the speed-up rollers.

9. The method of claim 7, wherein the feed roller spins freely, after the card comes into contact with the speed-up rollers.

* * * * *